US010290999B2

(12) United States Patent
Koike et al.

(10) Patent No.: US 10,290,999 B2
(45) Date of Patent: May 14, 2019

(54) SPARK PLUG

(71) Applicant: NGK SPARK PLUG CO., LTD., Nagoya-shi, Aichi (JP)

(72) Inventors: Kazuki Koike, Komaki (JP); Takehito Kuno, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/205,099

(22) Filed: Jul. 8, 2016

(65) Prior Publication Data

US 2017/0025822 A1 Jan. 26, 2017

(30) Foreign Application Priority Data

Jul. 22, 2015 (JP) ..... 2015-144579

(51) Int. Cl.
*H01T 13/32* (2006.01)
*H01T 13/16* (2006.01)

(52) U.S. Cl.
CPC ..... *H01T 13/32* (2013.01); *H01T 13/16* (2013.01)

(58) Field of Classification Search
CPC ..... H01T 13/32; H01T 13/16
See application file for complete search history.

(56) References Cited

U.S. PATENT DOCUMENTS 8,884,503 B2 11/2014 Nagasawa et al.
9,270,087 B2 2/2016 Nagasawa et al.
2005/0179353 A1* 8/2005 Watanabe ..... H01T 13/20 313/141
2010/0019644 A1* 1/2010 Fukuzawa ..... H01T 13/32 313/141
2010/0096968 A1* 4/2010 Ban ..... H01T 13/16 313/141
2010/0275870 A1 11/2010 Kameda et al.
2013/0214671 A1* 8/2013 Nagasawa ..... H01T 13/16 313/141
2014/0368105 A1 12/2014 Nagasawa et al.

FOREIGN PATENT DOCUMENTS

CN 103190043 A 7/2013
CN 106415956 A * 2/2017 ..... C22C 9/00
JP 2012-099496 A 5/2012 ..... F02P 13/00
WO WO-2015111634 A1 * 7/2015 ..... C22C 9/00

OTHER PUBLICATIONS

Office Action issued in corresponding Chinese Patent Application No. 201610579766.9 dated Nov. 23, 2017.

* cited by examiner

*Primary Examiner* — Kevin Quarterman
(74) *Attorney, Agent, or Firm* — Kusner & Jaffe

(57) ABSTRACT

A base end portion of a ground electrode of a spark plug includes a skin portion, an intermediate portion, and a core portion 52. A center cross section CP containing the center axis PX of the spark plug and the center axis EX of the base end portion includes a first multilayer portion in which the intermediate portion is disposed inward of the skin portion and the core portion is disposed inward of the intermediate portion, and a second multilayer portion in which the skin portion and the core portion are in direct contact with each other. The center cross section CP includes an intersection point PI at which a first boundary line BLa between the metallic shell and the skin portion and a second boundary line between the metallic shell and the core portion meet with a third boundary line BLc.

12 Claims, 25 Drawing Sheets

EX
85
82
52
51
50
83
83a
GD
42
42p
40
41
MX

EXPERIMENTAL EXAMPLE 1:

WELDING STRENGTH EVALUATION TEST

| SAMPLE NO. | SECTIONAL STRUCTURE | RESULTS (NUMBER OF TIMES BEFORE OCCURRENCE OF FRACTURE) |
|---|---|---|
| S11 | Z | 2 TIMES OR LESS |
| S12 | A | 3 TIMES |
| S13 | E | 4 TIMES |

FIG. 15

EXPERIMENTAL EXAMPLE 2:

WELDING STRENGTH EVALUATION TEST

| SAMPLE NO. | SECTIONAL STRUCTURE | RESULTS (NUMBER OF TIMES BEFORE OCCURRENCE OF FRACTURE) |
|---|---|---|
| S21 | B | 3 TIMES |
| S22 | D | 4 TIMES |
| S23 | F | 4 TIMES |
| S24 | H | 5 TIMES |

FIG. 16

EXPERIMENTAL EXAMPLE 3:

BREAKAGE STRENGTH EVALUATION TEST

| SAMPLE NO. | SECTIONAL STRUCTURE | CURVATURE RADIUS OF CURVED PORTION | RESULTS (TIME BEFORE OCCURRENCE OF FRACTURE) |
|---|---|---|---|
| S31 | G | — | LESS THAN 20 MIN |
| S32 | H | LESS THAN 0.5 mm | 20 MIN TO 60 MIN |
| S33 | H | 0.5 mm OR GREATER | NOT FRACTURED |

FIG. 17

EXPERIMENTAL EXAMPLE 4:

| | | | RESULTS | |
|---|---|---|---|---|
| SAMPLE NO. | SECTIONAL STRUCTURE | WELDING DEPTH L [mm] | WELDING STRENGTH EVALUATION TEST (NUMBER OF TIMES BEFORE OCCURRENCE OF FRACTURE) | SHELL STATE EVALUATION TEST (INTRUSION OF COPPER INTO METALLIC SHELL) |
| S41-1 | B | 0 < L < 0.2 | 3 TIMES | NOT OCCURRED |
| S41-2 | B | 0.2 | 4 TIMES | NOT OCCURRED |
| S41-3 | B | 0.4 | 5 TIMES | NOT OCCURRED |
| S41-4 | B | 1.2 | 5 TIMES | NOT OCCURRED |
| S41-5 | B | 1.5 | 5 TIMES | OCCURRED |
| S42-1 | C | 0 < L < 0.2 | 4 TIMES | NOT OCCURRED |
| S42-2 | C | 0.2 | 5 TIMES | NOT OCCURRED |
| S42-3 | C | 0.4 | 6 TIMES | NOT OCCURRED |
| S42-4 | C | 1.2 | 6 TIMES | NOT OCCURRED |
| S42-5 | C | 1.5 | 6 TIMES | OCCURRED |
| S43-1 | E | 0 < L < 0.2 | 4 TIMES | NOT OCCURRED |
| S43-2 | E | 0.2 | 5 TIMES | NOT OCCURRED |
| S43-3 | E | 0.4 | 6 TIMES | NOT OCCURRED |
| S43-4 | E | 1.2 | 6 TIMES | NOT OCCURRED |
| S43-5 | E | 1.5 | 6 TIMES | OCCURRED |
| S44-1 | G | 0 < L < 0.2 | 5 TIMES | NOT OCCURRED |
| S44-2 | G | 0.2 | 6 TIMES | NOT OCCURRED |
| S44-3 | G | 0.4 | 7 TIMES | NOT OCCURRED |
| S44-4 | G | 1.2 | 7 TIMES | NOT OCCURRED |
| S44-5 | G | 1.5 | 7 TIMES | OCCURRED |

FIG. 18

EXPERIMENTAL EXAMPLE 5(1):

| SAMPLE NO. | SECTIONAL STRUCTURE | WELDING DEPTH L [mm] | AL CONTENT [wt.%] | WELDING STRENGTH EVALUATION TEST (NUMBER OF TIMES BEFORE OCCURRENCE OF FRACTURE) | OXIDATION RESISTANCE EVALUATION TEST (T2/T1) |
|---|---|---|---|---|---|
| S51-1 | A | 0 < L < 0.2 | 0 | 4 TIMES | LESS THAN 0.5 |
| S51-2 | A | 0 < L < 0.2 | 2.5 | 4 TIMES | 0.5 OR GREATER |
| S51-3 | A | 0 < L < 0.2 | 5.0 | 3 TIMES | 0.5 OR GREATER |
| S51-4 | A | 0.2 | 0 | 5 TIMES | LESS THAN 0.5 |
| S51-5 | A | 0.2 | 2.5 | 5 TIMES | 0.5 OR GREATER |
| S51-6 | A | 0.2 | 5.0 | 4 TIMES | 0.5 OR GREATER |
| S51-7 | A | 0.4 | 0 | 6 TIMES | LESS THAN 0.5 |
| S51-8 | A | 0.4 | 2.5 | 6 TIMES | 0.5 OR GREATER |
| S51-9 | A | 0.4 | 5.0 | 5 TIMES | 0.5 OR GREATER |
| S51-10 | A | 1.2 | 0 | 6 TIMES | LESS THAN 0.5 |
| S51-11 | A | 1.2 | 2.5 | 6 TIMES | 0.5 OR GREATER |
| S51-12 | A | 1.2 | 5.0 | 5 TIMES | 0.5 OR GREATER |

FIG. 19

EXPERIMENTAL EXAMPLE 5(2):

| SAMPLE NO. | SECTIONAL STRUCTURE | RADIUS OF CURVED PORTION | WELDING DEPTH L [mm] | AL CONTENT [wt.%] | WELDING STRENGTH EVALUATION TEST (NUMBER OF TIMES BEFORE OCCURRENCE OF FRACTURE) | OXIDATION RESISTANCE EVALUATION TEST (T2/T1) |
|---|---|---|---|---|---|---|
| S52-1 | B | LESS THAN 0.5 mm | 0 < L < 0.2 | 0 | 4 TIMES | LESS THAN 0.5 |
| S52-2 | B | LESS THAN 0.5 mm | 0 < L < 0.2 | 2.5 | 4 TIMES | 0.5 OR GREATER |
| S52-3 | B | LESS THAN 0.5 mm | 0 < L < 0.2 | 5.0 | 3 TIMES | 0.5 OR GREATER |
| S52-4 | B | LESS THAN 0.5 mm | 0.2 | 0 | 5 TIMES | LESS THAN 0.5 |
| S52-5 | B | LESS THAN 0.5 mm | 0.2 | 2.5 | 5 TIMES | 0.5 OR GREATER |
| S52-6 | B | LESS THAN 0.5 mm | 0.2 | 5.0 | 4 TIMES | 0.5 OR GREATER |
| S52-7 | B | LESS THAN 0.5 mm | 0.4 | 0 | 6 TIMES | LESS THAN 0.5 |
| S52-8 | B | LESS THAN 0.5 mm | 0.4 | 2.5 | 6 TIMES | 0.5 OR GREATER |
| S52-9 | B | LESS THAN 0.5 mm | 0.4 | 5.0 | 5 TIMES | 0.5 OR GREATER |
| S52-10 | B | LESS THAN 0.5 mm | 1.2 | 0 | 6 TIMES | LESS THAN 0.5 |
| S52-11 | B | LESS THAN 0.5 mm | 1.2 | 2.5 | 6 TIMES | 0.5 OR GREATER |
| S52-12 | B | LESS THAN 0.5 mm | 1.2 | 5.0 | 5 TIMES | 0.5 OR GREATER |

FIG. 20

EXPERIMENTAL EXAMPLE 5(3):

| SAMPLE NO. | SECTIONAL STRUCTURE | RADIUS OF CURVED PORTION | WELDING DEPTH L [mm] | AL CONTENT [wt.%] | WELDING STRENGTH EVALUATION TEST (NUMBER OF TIMES BEFORE OCCURRENCE OF FRACTURE) | OXIDATION RESISTANCE EVALUATION TEST (T2/T1) |
|---|---|---|---|---|---|---|
| S53-1 | B | 0.5 mm OR GREATER | 0 < L < 0.2 | 0 | 4 TIMES | LESS THAN 0.5 |
| S53-2 | B | 0.5 mm OR GREATER | 0 < L < 0.2 | 2.5 | 4 TIMES | 0.5 OR GREATER |
| S53-3 | B | 0.5 mm OR GREATER | 0 < L < 0.2 | 5.0 | 3 TIMES | 0.5 OR GREATER |
| S53-4 | B | 0.5 mm OR GREATER | 0.2 | 0 | 5 TIMES | LESS THAN 0.5 |
| S53-5 | B | 0.5 mm OR GREATER | 0.2 | 2.5 | 5 TIMES | 0.5 OR GREATER |
| S53-6 | B | 0.5 mm OR GREATER | 0.2 | 5.0 | 4 TIMES | 0.5 OR GREATER |
| S53-7 | B | 0.5 mm OR GREATER | 0.4 | 0 | 6 TIMES | LESS THAN 0.5 |
| S53-8 | B | 0.5 mm OR GREATER | 0.4 | 2.5 | 6 TIMES | 0.5 OR GREATER |
| S53-9 | B | 0.5 mm OR GREATER | 0.4 | 5.0 | 5 TIMES | 0.5 OR GREATER |
| S53-10 | B | 0.5 mm OR GREATER | 1.2 | 0 | 6 TIMES | LESS THAN 0.5 |
| S53-11 | B | 0.5 mm OR GREATER | 1.2 | 2.5 | 6 TIMES | 0.5 OR GREATER |
| S53-12 | B | 0.5 mm OR GREATER | 1.2 | 5.0 | 5 TIMES | 0.5 OR GREATER |

FIG. 21

EXPERIMENTAL EXAMPLE 5(4):

| SAMPLE NO. | SECTIONAL STRUCTURE | WELDING DEPTH L [mm] | AL CONTENT [wt.%] | WELDING STRENGTH EVALUATION TEST (NUMBER OF TIMES BEFORE OCCURRENCE OF FRACTURE) | OXIDATION RESISTANCE EVALUATION TEST (T2/T1) |
|---|---|---|---|---|---|
| S54-1 | D | 0 < L < 0.2 | 0 | 5 TIMES | LESS THAN 0.5 |
| S54-2 | D | 0 < L < 0.2 | 2.5 | 5 TIMES | 0.5 OR GREATER |
| S54-3 | D | 0 < L < 0.2 | 5.0 | 4 TIMES | 0.5 OR GREATER |
| S54-4 | D | 0.2 | 0 | 6 TIMES | LESS THAN 0.5 |
| S54-5 | D | 0.2 | 2.5 | 6 TIMES | 0.5 OR GREATER |
| S54-6 | D | 0.2 | 5.0 | 5 TIMES | 0.5 OR GREATER |
| S54-7 | D | 0.4 | 0 | 7 TIMES | LESS THAN 0.5 |
| S54-8 | D | 0.4 | 2.5 | 7 TIMES | 0.5 OR GREATER |
| S54-9 | D | 0.4 | 5.0 | 6 TIMES | 0.5 OR GREATER |
| S54-10 | D | 1.2 | 0 | 7 TIMES | LESS THAN 0.5 |
| S54-11 | D | 1.2 | 2.5 | 7 TIMES | 0.5 OR GREATER |
| S54-12 | D | 1.2 | 5.0 | 6 TIMES | 0.5 OR GREATER |

FIG. 22

EXPERIMENTAL EXAMPLE 5(5):

| SAMPLE NO. | SECTIONAL STRUCTURE | WELDING DEPTH L [mm] | AL CONTENT [wt.%] | WELDING STRENGTH EVALUATION TEST (NUMBER OF TIMES BEFORE OCCURRENCE OF FRACTURE) | OXIDATION RESISTANCE EVALUATION TEST (T2/T1) |
|---|---|---|---|---|---|
| S55-1 | E | 0 < L < 0.2 | 0 | 5 TIMES | LESS THAN 0.5 |
| S55-2 | E | 0 < L < 0.2 | 2.5 | 5 TIMES | 0.5 OR GREATER |
| S55-3 | E | 0 < L < 0.2 | 5.0 | 4 TIMES | 0.5 OR GREATER |
| S55-4 | E | 0.2 | 0 | 6 TIMES | LESS THAN 0.5 |
| S55-5 | E | 0.2 | 2.5 | 6 TIMES | 0.5 OR GREATER |
| S55-6 | E | 0.2 | 5.0 | 5 TIMES | 0.5 OR GREATER |
| S55-7 | E | 0.4 | 0 | 7 TIMES | LESS THAN 0.5 |
| S55-8 | E | 0.4 | 2.5 | 7 TIMES | 0.5 OR GREATER |
| S55-9 | E | 0.4 | 5.0 | 6 TIMES | 0.5 OR GREATER |
| S55-10 | E | 1.2 | 0 | 7 TIMES | LESS THAN 0.5 |
| S55-11 | E | 1.2 | 2.5 | 7 TIMES | 0.5 OR GREATER |
| S55-12 | E | 1.2 | 5.0 | 6 TIMES | 0.5 OR GREATER |

FIG. 23

EXPERIMENTAL EXAMPLE 5(6):

| SAMPLE NO. | SECTIONAL STRUCTURE | RADIUS OF CURVED PORTION | WELDING DEPTH L [mm] | AL CONTENT [wt.%] | WELDING STRENGTH EVALUATION TEST (NUMBER OF TIMES BEFORE OCCURRENCE OF FRACTURE) | OXIDATION RESISTANCE EVALUATION TEST (T2/T1) |
|---|---|---|---|---|---|---|
| S56-1 | F | LESS THAN 0.5 mm | 0 < L < 0.2 | 0 | 5 TIMES | LESS THAN 0.5 |
| S56-2 | F | LESS THAN 0.5 mm | 0 < L < 0.2 | 2.5 | 5 TIMES | 0.5 OR GREATER |
| S56-3 | F | LESS THAN 0.5 mm | 0 < L < 0.2 | 5.0 | 4 TIMES | 0.5 OR GREATER |
| S56-4 | F | LESS THAN 0.5 mm | 0.2 | 0 | 6 TIMES | LESS THAN 0.5 |
| S56-5 | F | LESS THAN 0.5 mm | 0.2 | 2.5 | 6 TIMES | 0.5 OR GREATER |
| S56-6 | F | LESS THAN 0.5 mm | 0.2 | 5.0 | 5 TIMES | 0.5 OR GREATER |
| S56-7 | F | LESS THAN 0.5 mm | 0.4 | 0 | 7 TIMES | LESS THAN 0.5 |
| S56-8 | F | LESS THAN 0.5 mm | 0.4 | 2.5 | 7 TIMES | 0.5 OR GREATER |
| S56-9 | F | LESS THAN 0.5 mm | 0.4 | 5.0 | 6 TIMES | 0.5 OR GREATER |
| S56-10 | F | LESS THAN 0.5 mm | 1.2 | 0 | 7 TIMES | LESS THAN 0.5 |
| S56-11 | F | LESS THAN 0.5 mm | 1.2 | 2.5 | 7 TIMES | 0.5 OR GREATER |
| S56-12 | F | LESS THAN 0.5 mm | 1.2 | 5.0 | 6 TIMES | 0.5 OR GREATER |

FIG. 24

EXPERIMENTAL EXAMPLE 5(7):

| SAMPLE NO. | SECTIONAL STRUCTURE | RADIUS OF CURVED PORTION | WELDING DEPTH L [mm] | AL CONTENT [wt.%] | WELDING STRENGTH EVALUATION TEST (NUMBER OF TIMES BEFORE OCCURRENCE OF FRACTURE) | OXIDATION RESISTANCE EVALUATION TEST (T2/T1) |
|---|---|---|---|---|---|---|
| S57-1 | F | 0.5 mm OR GREATER | 0 < L < 0.2 | 0 | 5 TIMES | LESS THAN 0.5 |
| S57-2 | F | 0.5 mm OR GREATER | 0 < L < 0.2 | 2.5 | 5 TIMES | 0.5 OR GREATER |
| S57-3 | F | 0.5 mm OR GREATER | 0 < L < 0.2 | 5.0 | 4 TIMES | 0.5 OR GREATER |
| S57-4 | F | 0.5 mm OR GREATER | 0.2 | 0 | 6 TIMES | LESS THAN 0.5 |
| S57-5 | F | 0.5 mm OR GREATER | 0.2 | 2.5 | 6 TIMES | 0.5 OR GREATER |
| S57-6 | F | 0.5 mm OR GREATER | 0.2 | 5.0 | 5 TIMES | 0.5 OR GREATER |
| S57-7 | F | 0.5 mm OR GREATER | 0.4 | 0 | 7 TIMES | LESS THAN 0.5 |
| S57-8 | F | 0.5 mm OR GREATER | 0.4 | 2.5 | 7 TIMES | 0.5 OR GREATER |
| S57-9 | F | 0.5 mm OR GREATER | 0.4 | 5.0 | 6 TIMES | 0.5 OR GREATER |
| S57-10 | F | 0.5 mm OR GREATER | 1.2 | 0 | 7 TIMES | LESS THAN 0.5 |
| S57-11 | F | 0.5 mm OR GREATER | 1.2 | 2.5 | 7 TIMES | 0.5 OR GREATER |
| S57-12 | F | 0.5 mm OR GREATER | 1.2 | 5.0 | 6 TIMES | 0.5 OR GREATER |

FIG. 25

EXPERIMENTAL EXAMPLE 5(8):

| SAMPLE NO. | SECTIONAL STRUCTURE | WELDING DEPTH L [mm] | AL CONTENT [wt.%] | WELDING STRENGTH EVALUATION TEST (NUMBER OF TIMES BEFORE OCCURRENCE OF FRACTURE) | OXIDATION RESISTANCE EVALUATION TEST (T2/T1) |
|---|---|---|---|---|---|
| S58-1 | H | 0 < L < 0.2 | 0 | 6 TIMES | LESS THAN 0.5 |
| S58-2 | H | 0 < L < 0.2 | 2.5 | 6 TIMES | 0.5 OR GREATER |
| S58-3 | H | 0 < L < 0.2 | 5.0 | 5 TIMES | 0.5 OR GREATER |
| S58-4 | H | 0.2 | 0 | 7 TIMES | LESS THAN 0.5 |
| S58-5 | H | 0.2 | 2.5 | 7 TIMES | 0.5 OR GREATER |
| S58-6 | H | 0.2 | 5.0 | 6 TIMES | 0.5 OR GREATER |
| S58-7 | H | 0.4 | 0 | 8 TIMES | LESS THAN 0.5 |
| S58-8 | H | 0.4 | 2.5 | 8 TIMES | 0.5 OR GREATER |
| S58-9 | H | 0.4 | 5.0 | 7 TIMES | 0.5 OR GREATER |
| S58-10 | H | 1.2 | 0 | 8 TIMES | LESS THAN 0.5 |
| S58-11 | H | 1.2 | 2.5 | 8 TIMES | 0.5 OR GREATER |
| S58-12 | H | 1.2 | 5.0 | 7 TIMES | 0.5 OR GREATER |

FIG. 26

SPARK PLUG

RELATED APPLICATIONS

This application claims the benefit of Japanese Patent Application No. 2015-144579, filed Jul. 22, 2015, the entire contents of which are incorporated herein by reference.

FIELD OF THE INVENTION

The present invention relates to a spark plug.

BACKGROUND OF THE INVENTION

A spark plug is used for igniting a fuel gas in an internal combustion engine. In such a spark plug, a gap for generating spark discharge for ignition (also called "spark gap") is provided between a center electrode and a ground electrode. In general, the ground electrode is welded to a forward end portion of a metallic shell. In some cases, in order to enhance heat resistance, the ground electrode has a multilayer structure in which outer and inner portions of the ground electrode are formed of materials that differ in thermal conductivity and hardness (see, for example, Japanese Patent Application Laid-Open (kokai) No. 2012-99496).

The welding interface between the metallic shell and the multilayer ground electrode is formed by the constituent material of the metallic shell and the various materials forming the ground electrode. Therefore, in the case where the inner portion of the ground electrode is formed of a material of low hardness such as copper (Cu), the material of low hardness may lower the strength of welding between the metallic shell and the ground electrode. Also, in some cases, the shape of the juncture portion of the ground electrode may be a cause of lowering the strength of the ground electrode. As described above, there yet remains room for enhancement of the reliability of joining between the metallic shell and the ground electrode.

The present invention has been accomplished so as to address at least the above-described problem, and the present invention can be embodied as the following modes.

SUMMARY OF THE INVENTION

According to one mode of the present invention, a spark plug is provided. This spark plug comprises a center electrode, an insulator, a metallic shell, and a ground electrode. The insulator accommodates the center electrode. The metallic shell accommodates the insulator. The ground electrode has a distal end portion disposed to face a forward end portion of the center electrode with a predetermined gap formed therebetween, and a base end portion extending along the center electrode and joined to the metallic shell. The base end portion includes a skin portion disposed on a surface side of the base end portion, an intermediate portion which is higher in thermal conductivity than the skin portion, and a core portion which is higher in hardness than the intermediate portion. A cross section containing a center axis of the spark plug and a center axis of the base end portion includes a first portion in which the intermediate portion is disposed inward of the skin portion and the core portion is disposed inward of the intermediate portion, a second portion which is located on a rear end side of the first portion and in which the skin portion and the core portion are in direct contact with each other, and an intersection point at which a first boundary line, a second boundary line, and a third boundary line meet with one another. The first boundary line is a boundary line between the metallic shell and the skin portion. The second boundary line is a boundary line between the metallic shell and the core portion. The third boundary line is a boundary line between the skin portion and the core portion and extends toward a surface side from a rear-end-side end of a boundary line between the skin portion and the intermediate portion. According to the spark plug of this mode, the intermediate portion is restrained from existing at the welding interface between the ground electrode and the metallic shell. Therefore, the strength of welding of the ground electrode to the metallic shell is increased.

In accordance with a second aspect of the present invention, there is provided a spark plug of the above-described mode, wherein, in the cross section, the intersection point may be present on each of opposite sides of the center axis of the base end portion. According to the spark plug of this mode, the strength of welding of the ground electrode to the metallic shell is increased further.

In accordance with a third aspect of the present invention, there is provided a spark plug of the above-described mode, wherein the first boundary line may extend from the intersection point such that a distance between the first boundary line and the center axis of the base end portion increases toward the rear end side. According to the spark plug of this mode, it is possible to suppress a decrease in the welding strength which occurs when a portion of the skin portion which constitutes the outer surface thereof is present at the welding interface.

In accordance with a fourth aspect of the present invention, there is provided a spark plug of the above-described mode, wherein the skin portion may have a first outer surface which faces toward the center electrode and a second outer surface which faces toward a side opposite the first outer surface, and in the cross section, at least one of the first outer surface and the second outer surface may have a straight portion which extends substantially straight from a forward end side toward the rear end side, and a curved portion which extends from the straight portion toward the rear end side while curving outward. According to the spark plug of this mode, a decrease in the strength at the juncture portion of the ground electrode is restrained, whereby breakage of the ground electrode is restrained.

In accordance with a fifth aspect of the present invention, there is provided a spark plug of the above-described mode, wherein, in the cross section, the curved portion may have a curvature radius of 0.5 mm or greater. According to the spark plug of this mode, breakage of the ground electrode is restrained to a greater degree.

In accordance with a sixth aspect of the present invention, there is provided a spark plug of the above-described mode, wherein, in the cross section, the second boundary line may be convex toward the metallic shell. According to the spark plug of this mode, the area of contact between the metallic shell and the core portion increases. Therefore, the strength of welding of the ground electrode to the metallic shell is increased further.

In accordance with a seventh aspect of the present invention, there is provided a spark plug of the above-described mode, wherein, the ground electrode is joined to an end surface of a forward end portion of the metallic shell, and when an imaginary plane which contains an end surface of a portion of the forward end portion to which the ground electrode is not joined is defined, in the cross section, a maximum value L of a distance between an imaginary straight line representing the imaginary plane and the boundary line between the ground electrode and the metallic shell may satisfy a relation of L>0 mm, where the distance assumes a positive value when the boundary line between the ground electrode and the metallic shell is located on the rear end side of the imaginary straight line. According to the spark plug of this mode, the strength of welding of the ground electrode to the metallic shell is increased further.

In accordance with an eighth aspect of the present invention, there is provided a spark plug of the above-described mode, wherein the maximum value L may satisfy a relation of L≥0.2 mm. According to the spark plug of this mode, the strength of welding of the ground electrode to the metallic shell is increased further.

In accordance with a ninth aspect of the present invention, there is provided a spark plug of the above-described mode, wherein the maximum value L may satisfy a relation of L≥0.4 mm. According to the spark plug of this mode, the strength of welding of the ground electrode to the metallic shell is increased further.

In accordance with a tenth aspect of the present invention, there is provided a spark plug of the above-described mode, wherein the maximum value L may satisfy a relation of L<1.5 mm. According to the spark plug of this mode, deterioration of the metallic shell at the juncture portion of the ground electrode is restrained.

In accordance with an eleventh aspect of the present invention, there is provided a spark plug of the above-described mode, wherein the skin portion may have an aluminum content WP which satisfies a relation of 0 wt. %<WP<5.0 wt %. According to the spark plug of this mode, it is possible to increase the strength of welding of the ground electrode to the metallic shell while enhancing the oxidation resistance of the ground electrode.

All the plurality of constituent elements of each mode of the present invention are not essential. In order to solve, partially or entirely, the above-mentioned problem or yield, partially or entirely, the effects described in the present specification, a part of the elements may be properly modified, deleted, or replaced with another new element, or the limitation thereof may be partially removed. Also, in order to solve, partially or entirely, the above-mentioned problem or yield, partially or entirely, the effects described in the present specification, a portion or all of the above-described technical features contained in one mode of the present invention may be combined with a portion or all of the above-described technical features contained in other modes of the present invention to thereby attain an independent mode of the present invention.

The present invention can be realized in various forms other than the spark plug. For example, the present invention can be realized as an internal combustion engine equipped with a spark plug or a metallic shell to which a ground electrode is joined. Also, the present invention can be realized as a method of manufacturing a spark plug, a method of joining a ground electrode to a metallic shell, a metallic shell, a method of manufacturing the metallic shell, or apparatuses for executing these methods.

BRIEF DESCRIPTION OF THE DRAWINGS

FIG. 15 is an explanatory view showing a table in which the test results of Experimental Example 1 are summarized.

FIG. 16 is an explanatory view showing a table in which the test results of Experimental Example 2 are summarized.

FIG. 17 is an explanatory view showing a table in which the test results of Experimental Example 3 are summarized.

FIG. 18 is an explanatory view showing a table in which the test results of Experimental Example 4 are summarized.

FIG. 19 is an explanatory view showing a table in which the test results of Experimental Example 5 are summarized.

FIG. 20 is an explanatory view showing a table in which the test results of Experimental Example 5 are summarized.

FIG. 21 is an explanatory view showing a table in which the test results of Experimental Example 5 are summarized.

FIG. 22 is an explanatory view showing a table in which the test results of Experimental Example 5 are summarized.

FIG. 23 is an explanatory view showing a table in which the test results of Experimental Example 5 are summarized.

FIG. 24 is an explanatory view showing a table in which the test results of Experimental Example 5 are summarized.

FIG. 25 is an explanatory view showing a table in which the test results of Experimental Example 5 are summarized.

FIG. 26 is an explanatory view showing a table in which the test results of Experimental Example 5 are summarized.

DETAILED DESCRIPTION OF THE PREFERRED EMBODIMENTS

A. First Embodiment

Structure of a Spark Plug

Figure 1:
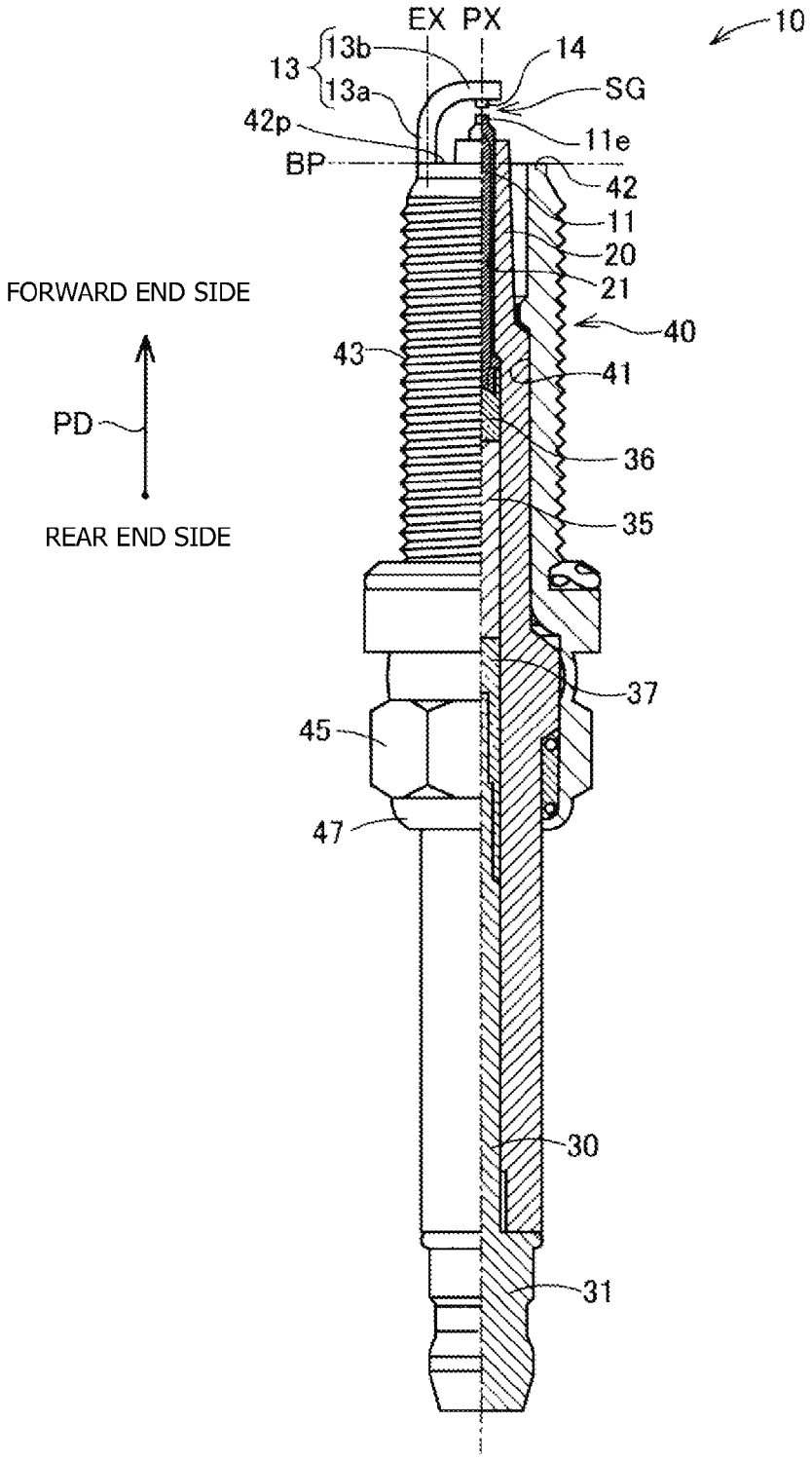
FIG. 1 is a schematic side view showing the structure of a spark plug in a first embodiment.
Figure 2:
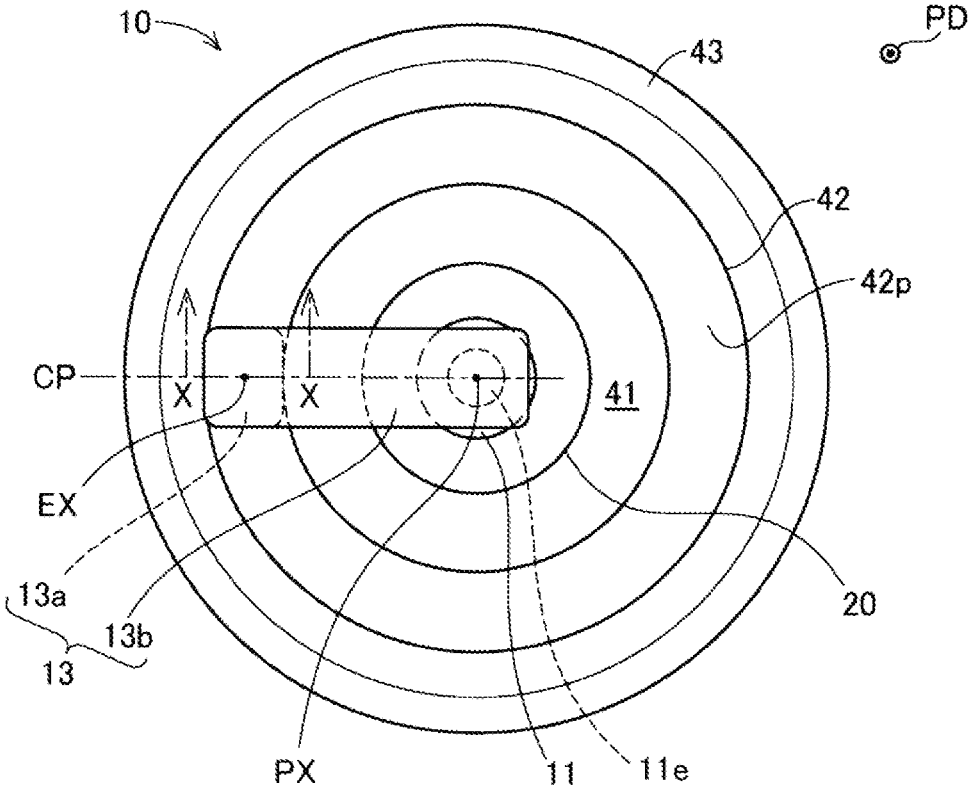
FIG. 2 is a schematic plan view showing the structure of the spark plug in the first embodiment.

The structure of a spark plug 10 according to a first embodiment will be briefly described with reference to FIGS. 1 and 2. FIG. 1 is schematic side view of the spark plug 10 of the first embodiment as viewed in a direction orthogonal to the center axis PX thereof. In FIG. 1, the center axis PX of the spark plug 10 is shown by an alternate long and short dash line. In FIG. 1, for convenience, a portion of the spark plug 10 on the right-hand side of the center axis PX on the sheet is depicted in a schematic cross section so as to show the internal structure. An arrow PD in FIG. 1 shows a direction which is parallel to the center axis PX (also referred as the "axial direction") and is directed from the rear end side of the spark plug 10 toward the forward end side thereof. The center axis PX and the arrow PD are shown in other drawings when necessary. FIG. 2 is a schematic plan view of the spark plug 10 as viewed along the axial direction from the forward end side toward the rear end side. Notably, in FIG. 2, for convenience, portions of the spark plug 10 other than the portion on the forward end side thereof are not illustrated.

The spark plug 10 (FIG. 1) is attached to an internal combustion engine (not shown) and is used to ignite a fuel gas. When the spark plug 10 is attached to the internal combustion engine, one end of the spark plug 10 on the forward end side (the upper side of the sheet) is disposed in a combustion chamber of the internal combustion engine and the other end of the spark plug 10 on the rear end side (the lower side of the sheet) is disposed outside the combustion chamber. The spark plug 10 includes a center electrode 11, a ground electrode 13, an insulator 20, a terminal 30, and a metallic shell 40.

The center electrode 11 has a rod-like shape. The center electrode 11 is held by the metallic shell 40 with the insulator 20 disposed therebetween such that the center axis of the center electrode 11 coincides with the center axis PX of the spark plug 10 and a forward end portion 11*e* of the center electrode 11 is exposed to the outside. The center electrode 11 is electrically connected to an external power supply (not shown) through the terminal 30 disposed on the rear end side.

The ground electrode 13 is attached to an open end 42 of the metallic shell 40 on the forward end side and electrically communicates with the metallic shell 40. The ground electrode 13 has a base end portion 13*a* and a distal end portion 13*b*. The base end portion 13*a* is a portion which extends approximately straight, along the axial direction, from the forward-end-side open end 42 of the metallic shell 40 toward the forward end side (FIG. 1). The center axis EX of the base end portion 13*a* is parallel to the center axis PX of the spark plug 10. The distal end portion 13*b* is a portion which extends from the base end portion 13*a* while bending and then extends toward a forward end portion 11*e* of the center electrode 11 (FIGS. 1 and 2). A tip portion 14 is provided on the distal end portion 13*b* (FIG. 1). At the end of the distal end portion 13*b*, the tip portion 14 projects toward the forward end portion 11*e* of the center electrode 11. The tip portion 14 may be omitted.

In the present embodiment, the ground electrode 13 has a multilayer structure in which a plurality of layers of different members are layered. In the present embodiment, the ground electrode 13 is welded to the open end 42 of the metallic shell 40. The internal structure of the ground electrode 13 and the welding between the ground electrode 13 and the metallic shell 40 will be described in detail later.

A predetermined gap SG for generating spark discharge is provided between the tip portion 14 of the ground electrode 13 and the forward end portion 11*e* of the center electrode 11 (FIG. 1). The spark plug 10 ignites the fuel gas by generating spark discharge at the gap SG. In the following description, the gap SG will also be referred to as the "spark discharge gap SG." Notably, in the case where the tip portion 14 is omitted, the gap between the forward end portion 11*e* of the center electrode 11 and the distal end portion 13*b* of the ground electrode 13 which faces the forward end portion 11*e* serves as the spark discharge gap SG for spark discharge.

The insulator 20 is a tubular insulating member and has an axial hole 21 which penetrates the insulator 20 at the center thereof (FIG. 1). The center axis of the insulator 20 coincides with the center axis PX of the spark plug 10. The insulator 20 is formed of, for example, sintered ceramic containing alumina, aluminum nitride, or the like as a main component.

The center electrode 11 is held in a forward end portion of the axial hole 21 of the insulator 20. The forward end portion 11*e* of the center electrode 11 projects outward from the forward end of the insulator 20. The rod-shaped terminal 30 is inserted into a rear end portion of the axial hole 21 of the insulator 20 from the rear end side. Notably, a rear end portion 31 of the terminal 30 is disposed outside the insulator 20 so that the rear end portion 31 of the terminal 30 can be connected to the external power supply (not shown).

A first glass seal material 36, a resistor 35, and a second glass seal material 37 are accommodated in the axial hole 21 of the insulator 20 in this order from the forward end side to be located between the center electrode 11 and the terminal 30. The center electrode 11 is electrically connected to the terminal 30 through the first glass seal material 36, the resistor 35, and the second glass seal material 37. As a result, in the spark plug 10, radio noise at the time of generation of spark discharge is suppressed.

The metallic shell 40 is a tubular metallic member having a bore 41 which penetrates the metallic shell 40 at the center thereof. The center axis of the metallic shell 40 coincides with the center axis PX of the spark plug 10. The metallic shell 40 is formed of, for example, carbon steel. The insulator 20 is accommodated in the bore 41 of the metallic shell 40. The insulator 20 is fixedly disposed in the bore 41 such that forward and rear end portions of the insulator 20 extend to the outside. As described above, the ground electrode 13 is welded to the forward-end-side open end 42 of the metallic shell 40.

A screw portion 43 which engages with a thread groove of an attachment hole (not shown) of the internal combustion engine is provided on the outer circumferential surface of a forward end portion of the metallic shell 40. A tool engagement portion 45 is provided on the rear end side of the screw portion 43. A tool is engaged with the tool engagement portion 45 when the spark plug 10 is attached to the internal combustion engine. A crimped portion 47 is provided on the rear end side of the tool engagement portion 45. As a result of crimping, the crimped portion 47 fixes a portion of the insulator 20 on the rear end side. The crimped portion 47 is formed by crimping inward an open end of the metallic shell 40 on the rear end side.

Structures of the Ground Electrode and its Juncture Portion

Figure 3:
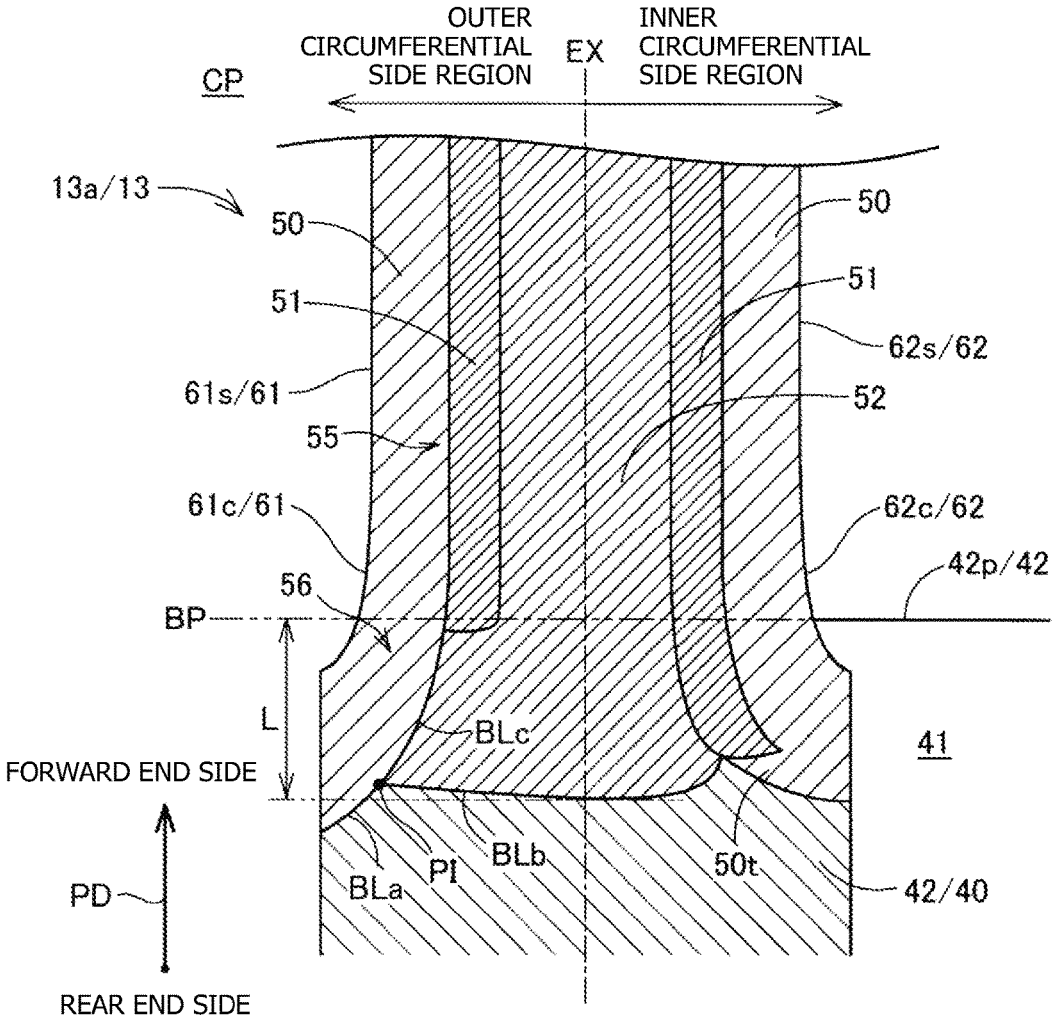
FIG. 3 is a schematic sectional view of a juncture portion between a ground electrode and a metallic shell in the first embodiment.

FIG. 3 is a schematic sectional view showing a cross section of the juncture portion between the ground electrode 13 and the metallic shell 40 taken along the line X-X shown in FIG. 2. The cross section taken along the line X-X of FIG. 2 corresponds to a cross section CP which contains the center axis PX of the spark plug 10 and the center axis EX of the base end portion 13*a*. In the following description, the cross section CP will be also referred to as the "center cross section CP." The ground electrode 13 is composed of a plurality of portions formed of different materials, and includes at least a skin portion 50, an intermediate portion 51, and a core portion 52.

The skin portion 50 is provided on the surface side of the ground electrode 13 and constitutes the surface layer of the ground electrode 13. The skin portion 50 is formed of a metallic material which is high in heat resistance and is the highest in hardness among the metallic materials used to form the ground electrode 13. The skin portion 50 is formed of an Ni-based heat resisting alloy containing nickel (Ni) as a main component such as NCF601. In the present specification, the term "main component" means a material component whose content is the highest. Notably, it is desired that the alloy used to form the skin portion 50 contain aluminum (Al) at a predetermined ratio. The Al content of the skin portion 50 will be described later.

The intermediate portion 51 is provided on the inner side of the skin portion 50. The intermediate portion 51 is formed of a metallic material which is higher in thermal conductivity than the skin portion 50. Also, it is desired that the intermediate portion 51 be formed of a metallic material which is higher in thermal conductivity than the metallic material used to form the core portion 52. The intermediate portion 51 is formed of, for example, pure Cu or a Cu alloy.

The core portion 52 is provided at the center of the ground electrode 13, and at the base end portion 13*a*, the core portion 52 is provided at a position through which the center axis EX passes. The core portion 52 is formed of a metallic material which is higher in hardness than the intermediate portion 51. The core portion 52 is formed of, for example, pure Ni or an Ni alloy.

In the ground electrode 13 of the present embodiment, the greater part of the base end portion 13*a* is formed of a first multilayer portion 55 having a multilayer structure in which a layer of the skin portion 50, a layer of the intermediate portion 51, and a layer of the core portion 52 are successively layered in this order from the outer surface toward the center axis EX. The first multilayer portion 55 corresponds to a subgeneric concept of the first portion in the present invention. The first multilayer portion 55 is formed on opposite sides of the center axis EX.

Since the ground electrode 13 includes the intermediate portion 51, which is high in thermal conductivity, the ground electrode 13 has an enhanced heat radiation performance and an enhanced heat resistance. Since the intermediate portion 51 of the ground electrode 13 is sandwiched between the skin portion 50 and the core portion 52, which are high in hardness, the ground electrode 13 has an increased strength and an enhanced durability.

In the ground electrode 13 of the present embodiment, a portion 56 in which is the skin portion 50 is in direct contact with the core portion 52 without the presence of the intermediate portion 51 therebetween at least in the center cross section CP is formed on the rear end side of the first multilayer portion 55. In the following description, that portion 56 will also be referred to as a "second multilayer portion 56." The second multilayer portion 56 corresponds to a subgeneric concept of the second portion in the present invention.

In the center cross section CP, the skin portion 50 is in contact with the core portion 52 as follows in the second multilayer portion 56. In a region (hereinafter also referred to as the "outer circumferential side region") on the side opposite the center electrode 11 with respect to the center axis EX of the base end portion 13*a*, an end portion of the core portion 52 on the rear end side extends toward the skin portion 50 and comes into contact with the skin portion 50. Meanwhile, in a region (hereinafter also referred to as the "inner circumferential side region") on the side toward the center electrode 11 with respect to the center axis EX of the base end portion 13*a*, an end portion 50*t* of the skin portion 50 on the rear end side extends toward the core portion 52 while bending and comes into contact with the core portion 52. This end portion 50*t* is a portion which partially constitutes the outer surface of the skin portion 50 before welding. Notably, in the present specification, the side of the base end portion 13*a* toward the center electrode 11 (the right-hand side of the sheet of FIG. 3) will be referred to as the "inner circumferential side," and the side of the base end portion 13*a* opposite the center electrode 11 (the left-hand side of the sheet of FIG. 3) will be referred to as the "outer circumferential side."

Further, in the spark plug 10 of the present embodiment, an intersection point PI which will be described below is formed at least in the second multilayer portion 56 in the center cross section CP. In the present embodiment, the intersection point PI is formed in the outer circumferential side region. The intersection point PI is a point at which the following three boundary lines BLa, BLb, and BLc meet. The first boundary line BLa is the boundary line between the metallic shell 40 and the skin portion 50. The second boundary line BLb is the boundary line between the metallic shell 40 and the core portion 52. The third boundary line BLc is the boundary line between the skin portion 50 and the core portion 52 and extends toward the surface side from the rear-end-side end of the boundary line between the skin portion 50 and the intermediate portion 51.

Since the constituent material of the intermediate portion 51 is low in hardness although it is high in thermal conductivity, its degree of contribution to the welding strength is small. In the case where, at least in the center cross section CP, the intersection point PI is present in the second multilayer portion 56, the constituent material of the intermediate portion 51 is restrained from existing at the welding interface between the ground electrode 13 and the metallic shell 40. Also, when a portion (e.g., the end portion 50*t*) which forms the outer surface of the skin portion 50 before welding enters the welding interface between the ground electrode 13 and the metallic shell 40, external foreign substances such as oxygen atoms are restrained from reaching the welding interface. Accordingly, deterioration in the welding between the ground electrode 13 and the metallic shell 40, which deterioration occurs due to the presence of foreign substances or the constituent material of the intermediate portion 51 at the welding interface, is restrained, whereby the strength of the welding between the ground electrode 13 and the metallic shell 40 is increased.

In the spark plug 10 of the present embodiment, in the center cross section CP, the first boundary line BLa, which the boundary line between the metallic shell 40 and the skin portion 50, extends toward the rear end side such that the distance between the first boundary line BLa and the center axis EX of the base end portion 13*a* increases toward the rear end side. As described above, in the spark plug 10 of the present embodiment, at the juncture portion between the ground electrode 13 and the metallic shell 40, the hard skin portion 50 intrudes into the metallic shell 40 more deeply. Therefore, the strength of welding between the ground electrode 13 and the metallic shell 40 increases.

In the spark plug 10 of the present embodiment, the skin portion 50 has a first outer surface 61 on the outer circumferential side and a second outer surface 62 on the inner circumferential side in the center cross section CP. The two outer surfaces 61 and 62 have straight portions 61*s* and 62*s* and curved portions 61*c* and 62*c*, respectively. The straight portions 61*s* and 62*s* extend approximately straight from the forward end side toward the rear end side. The curved portions 61*c* and 62*c* extend from the straight portions 61*s* and 62*s*, respectively, toward the rear end side while curving in directions away from the center axis EX.

As described above, in the spark plug 10 of the present embodiment, the curved portions 61*c* and 62*c* of the skin portion 50 are formed in a rear-end-side region near the juncture portion of the ground electrode 13. Therefore, it is possible to restrain the occurrence of stress concentration in the vicinity of the juncture portion of the ground electrode 13. Therefore, it is possible to restrain breakage of the ground electrode 13, which breakage occurs due to the occurrence of stress concentration at the juncture portion of the ground electrode 13. In particular, in the present embodiment, the skin portion 50 have the curved portions 61*c* and 62*c* on the opposite sides of the center axis EX. Therefore, the occurrence of stress concentration at the juncture portion of the ground electrode 13 is restrained further. Notably, as will be described in experimental examples which will be descried later, it is desired that, in the center cross section CP, each of the curved portions 61*c* and 62*c* depict a curved line having a curvature radius of 0.5 mm or greater (e.g., 0.5 to 0.7 mm).

Here, an imaginary plane BP is defined such that the imaginary plane BP contains an open end surface 42*p* of the metallic shell 40 on the forward end side. The open end surface 42*p* is the end surface of a portion of the open end of the metallic shell 40, to which portion the ground electrode 13 is not joined. In this case, it is desired that, in the cross section shown in FIG. 3, the maximum value L of the distance between an imaginary straight line (indicated by an alternate long and two short dashes line) representing the imaginary plane BP and the boundary line between the ground electrode 13 and the metallic shell 40 be greater than 0 mm, wherein the distance assumes a positive value when the boundary line between the ground electrode 13 and the metallic shell 40 is located on the rear end side of the imaginary straight line.

L represents the depth to which the metallic shell 40 melts when the ground electrode 13 is welded thereto. The greater the depth L (>0), the greater the degree to which the strength of welding between the ground electrode 13 and the metallic shell 40 increases. In the following description, the depth L will also be referred to as the "welding depth L" The welding depth L is desirably 0.2 mm or greater, and more desirably 0.4 mm or greater. However, in the case where the welding depth L is excessively large, during welding, a portion of the melted constituent material of the intermediate portion 51 intrudes into the metallic shell 40, and the constituent material intruded into the metallic shell 40 may cause corrosion and/or deterioration of the metallic shell 40 later on. Therefore, as will be described in the experimental examples which will be described later, the welding depth L is preferably less than 1.5 mm, and more preferably 1.2 mm or less.

As described above, it is desired that the alloy used to form the skin portion 50 contain Al. Namely, it is desired that the Al content WP of the alloy used to form the skin portion 50 is greater than 0 wt. %. This is because, as will be described in the experimental examples which will be described later, when the skin portion 50 contains Al, the durability of the ground electrode 13 can be enhanced. However, the Al content WP of the alloy used to form the skin portion 50 is desirably less than 5.0 wt. %, and more desirably 2.5 wt. % or less. This is because, as will be described in the experimental examples which will be described later, when the Al content WP is 5.0 wt. % or greater, the strength of welding to the metallic shell 40 may lower.

Since the Al content of NCF601 falls within the above-described preferred range as will be described below, NCF601 is preferably used as the constituent material of the skin portion 50.

Components contained in NCF601

Ni: 58 to 63 wt. %

Chromium (Cr): 21 to 25 wt. %

•Silicon (Si): 0 to 0.5 wt. %

Al: 1.0 to 1.7 wt. %

Manganese (Mn): 0 to 0.5 wt. %

Carbon (C): 0.02 to 0.05 wt. %

Balance being unavoidable impurities and Fe

Examples of the "unavoidable impurities" include phosphorus (P) in an amount of 0.03 wt. % or less and sulfur (S) in an amount of 0.03 wt. % or less.

Figures 4A, 4B, 4C:
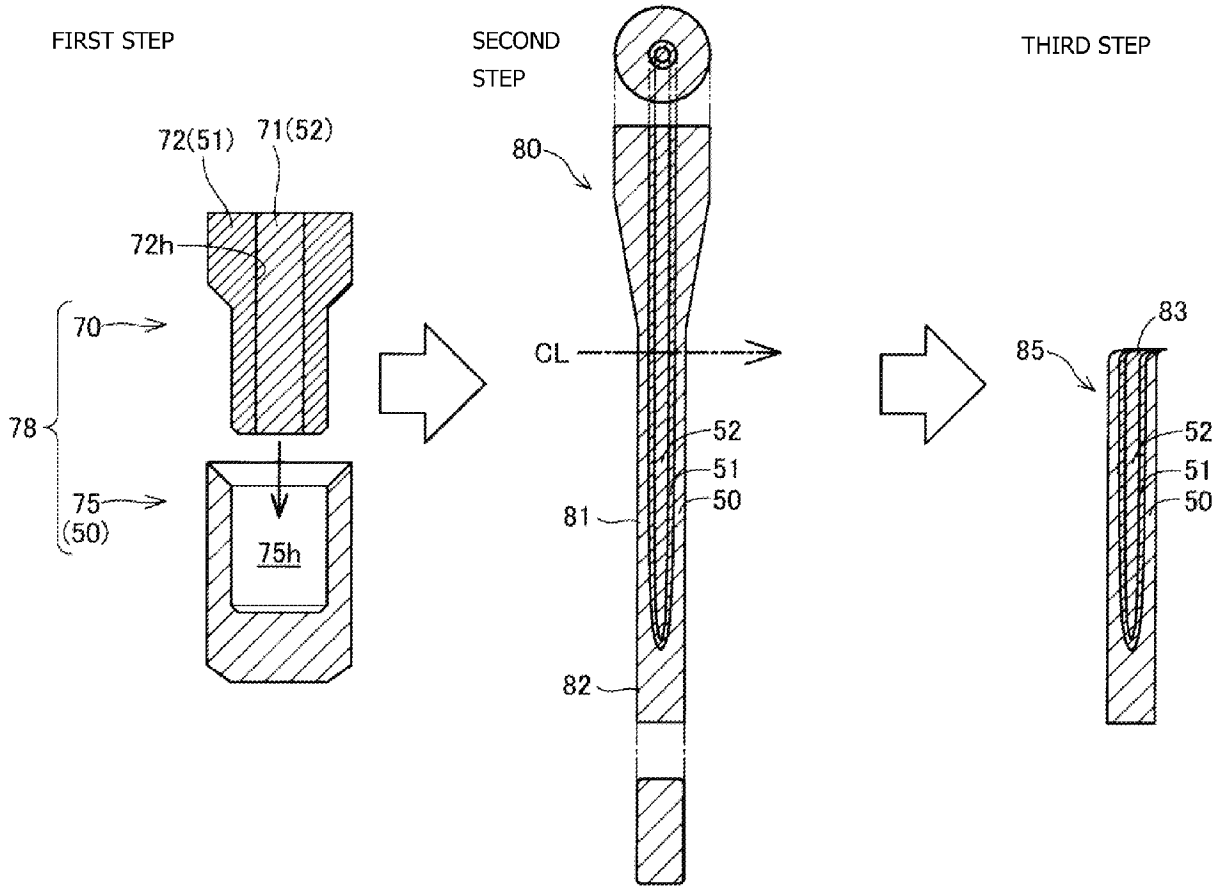
FIGS. 4(*a*), 4(*b*) and 4(*c*) are explanatory views schematically showing steps for manufacturing a ground electrode base material in the first embodiment.

Steps for Manufacturing the Ground Electrode and Steps for Joining the Ground Electrode Steps for manufacturing the base material of the ground electrode 13 and steps for welding the base material to the metallic shell 40 will be described successively with reference to FIGS. 4 and 5. The first through third steps schematically shown in FIG. 4 are the steps for manufacturing the base material of the ground electrode 13. In the first step, a first base material 70 and a second base material 75 are prepared, and a third base material 78 is made by combining these two base materials 70 and 75 (section (a) of FIG. 4).

The first base material 70 is made as follows. A metallic material for forming the core portion 52 is shaped into a circular columnar shape by means of, for example, cold forging, whereby a core portion base material 71 is made. Similarly, a metallic material for forming the intermediate portion 51 is shaped into a cylindrical tubular shape by means of, for example, cold forging, whereby an intermediate portion base material 72 is made. The core portion base material 71 is inserted into a bore 72*h* of the intermediate portion base material 72 such that the core portion base material 71 is mated and integrated with the intermediate portion base material 72, whereby the first base material 70 is made.

The second base material 75 is made by shaping a metallic material for forming the skin portion 50 into the shape of a cylindrical tube with a bottom by means of, for example, cold forging. The third base material 78 is made by inserting the first base material 70 into a bore 75*h* of the second base material 75 such that the first base material 70 is mated with the second base material 75.

In the second step, an extended base material 80 is made by performing extrusion forming; i.e., extruding the third base material 78, along its center axis, toward the second base material 75 side (section (b) of FIG. 4). A forward-end-side portion 81 of the extended base material 80, which portion is extended as a result of the extrusion, has an approximately rectangular cross section. Up to a forward-end-side intermediate point in the extrusion direction, the forward-end-side portion 81 has a multiplayer structure in which the core portion 52, the intermediate portion 51, the skin portion 50 are layered. The core portion 52 and the intermediate portion 51 are tapered toward the forward end side, and an end portion 82 of the forward-end-side portion 81 is constituted by the skin portion 50 only.

In the third step, the forward-end-side portion 81 is cut out from the extended base material 80, by means of cutting work, as a ground electrode base material 85 which constitutes the ground electrode 13 (section (c) of FIG. 4). This cutting work is performed by moving a cutting tool in one direction as indicated by an arrow CL in the section (b) of FIG. 4. The cutting direction in the present embodiment is a direction from a surface which faces the center electrode 11 when the ground electrode base material 85 is welded to the metallic shell 40 toward a surface on the opposite side. Notably, as a result of this cutting work, in a rear end portion 83 of the ground electrode base material 85, the layered structure formed by the skin portion 50, the intermediate portion 51, and the core portion 52 distorts in the cutting direction.

Figures 5A, 5B, 5C:
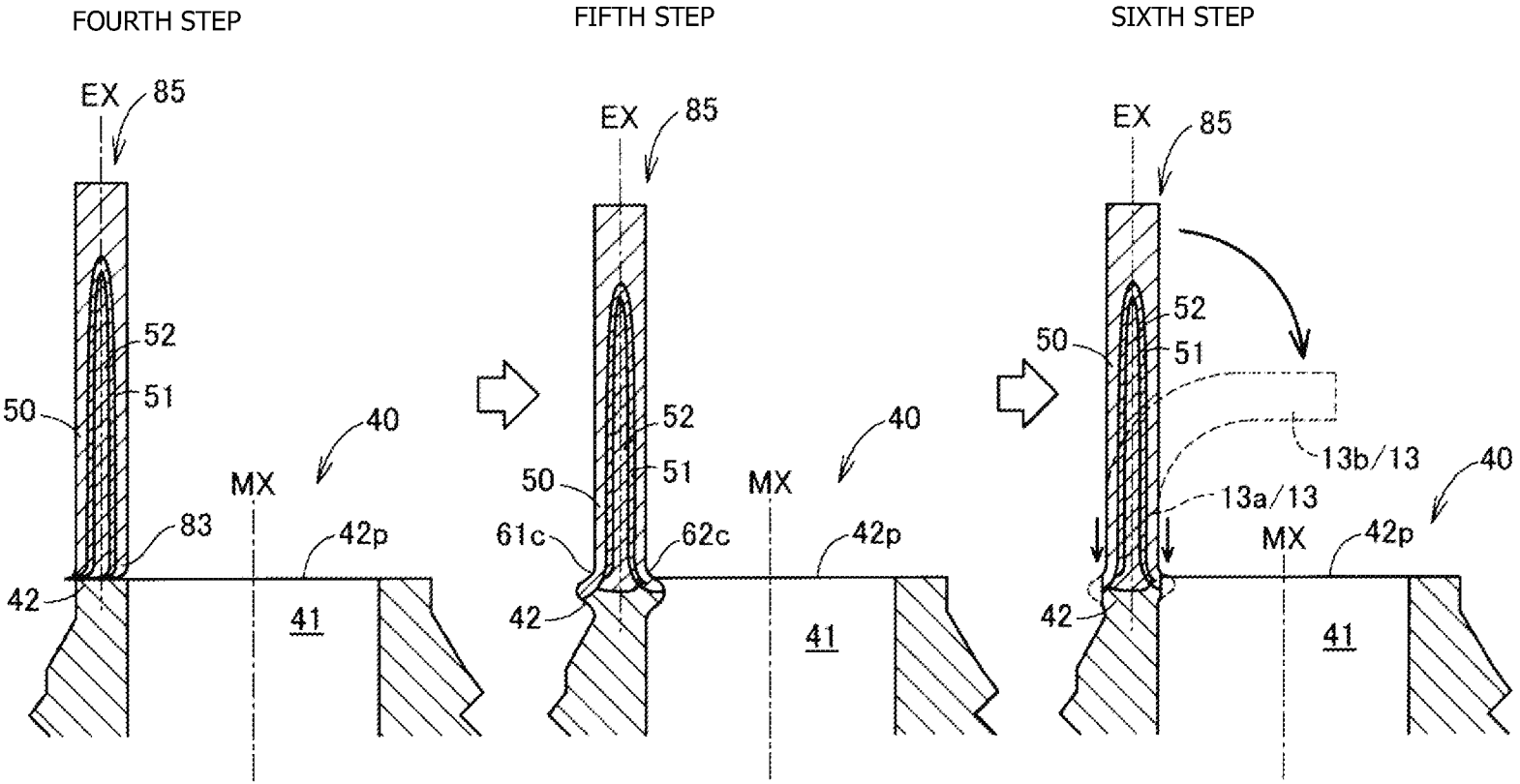
FIGS. 5(*a*), 5(*b*) and 5(*c*) are explanatory views schematically showing steps for welding the ground electrode base material in the first embodiment.

The fourth through sixth steps schematically shown in FIG. 5 are the steps for welding the ground electrode 13. In the fourth step, the rear end portion 83 of the ground electrode base material 85 is disposed on the open end surface 42*p* of the metallic shell 40 on the forward end side thereof such that the center axis EX of the ground electrode base material 85 becomes parallel to the center axis MX of the metallic shell 40 (section (a) of FIG. 5).

In the fifth step, the rear end portion 83 of the ground electrode base material 85 is pressed against the open end 42 of the metallic shell 40 on the forward end side thereof, and a high-frequency current is supplied such that the high-frequency current flows through the ground electrode base material 85 and the metallic shell 40, whereby the ground electrode base material 85 is resistance-welded to the metallic shell 40 (section (b) of FIG. 5). In the fifth step, the magnitude of the current, the current supply time, etc. are controlled such that the constituent material of the melted intermediate portion 51 does not flow out to the outside beyond the skin portion 50 and the skin portion 50 is gently deformed to form curved portions 61*c* and 62*c*.

In the sixth step, bulges of the juncture portion formed as result of melting of the constituent materials of the ground electrode base material 85 and the metallic shell 40 are removed by means of, for example, cutting work or polishing work (section (c) of FIG. 5). Subsequently, after a plating step, etc., the ground electrode base material 85 is bent toward the center axis MX of the metallic shell 40, whereby the ground electrode 13 having the base end portion 13*a* and the distal end portion 13*b* is formed. By the steps described above, there are formed the ground electrode 13 which has the sectional structure in the center cross section CP which has been described with reference to FIG. 3 and the juncture portion between the ground electrode 13 and the metallic shell 40.

Other Structural Examples of the First Embodiment

Figure 6:
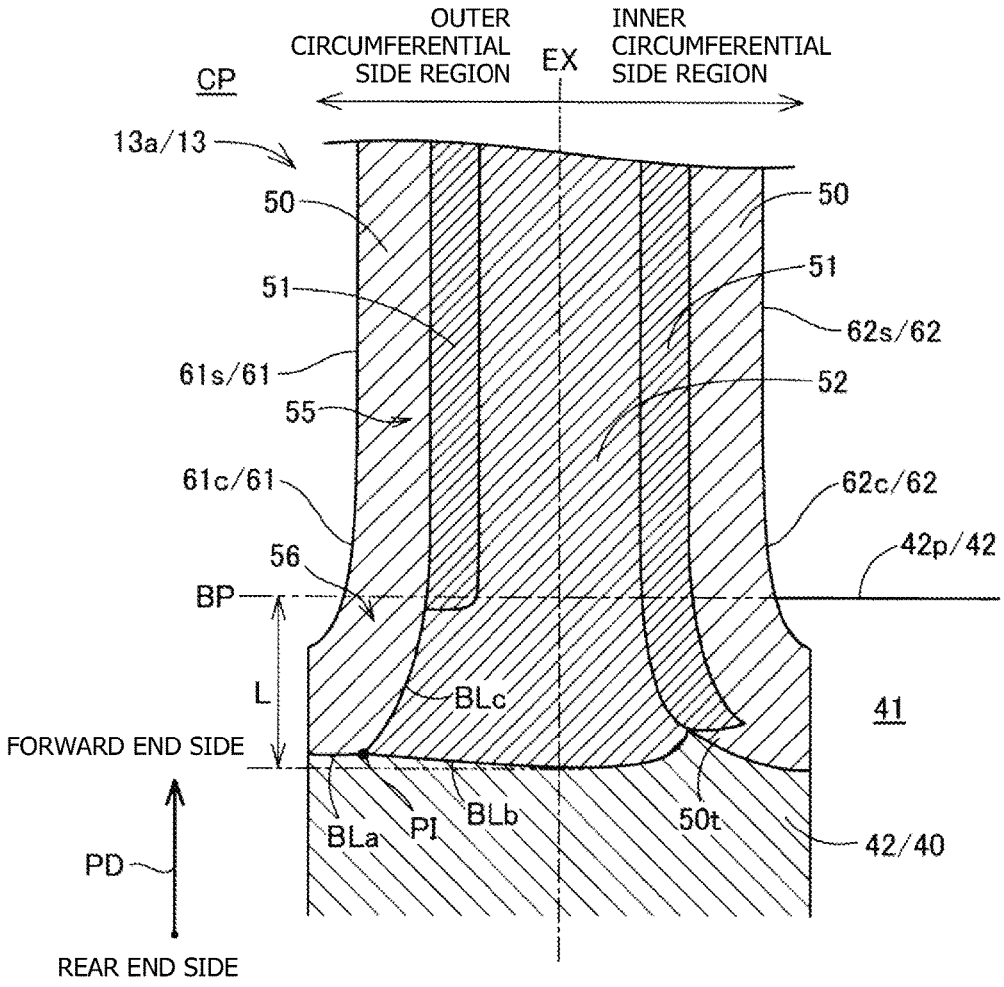
FIG. 6 is a schematic view showing another structural example of the juncture portion in the first embodiment.
Figure 7:
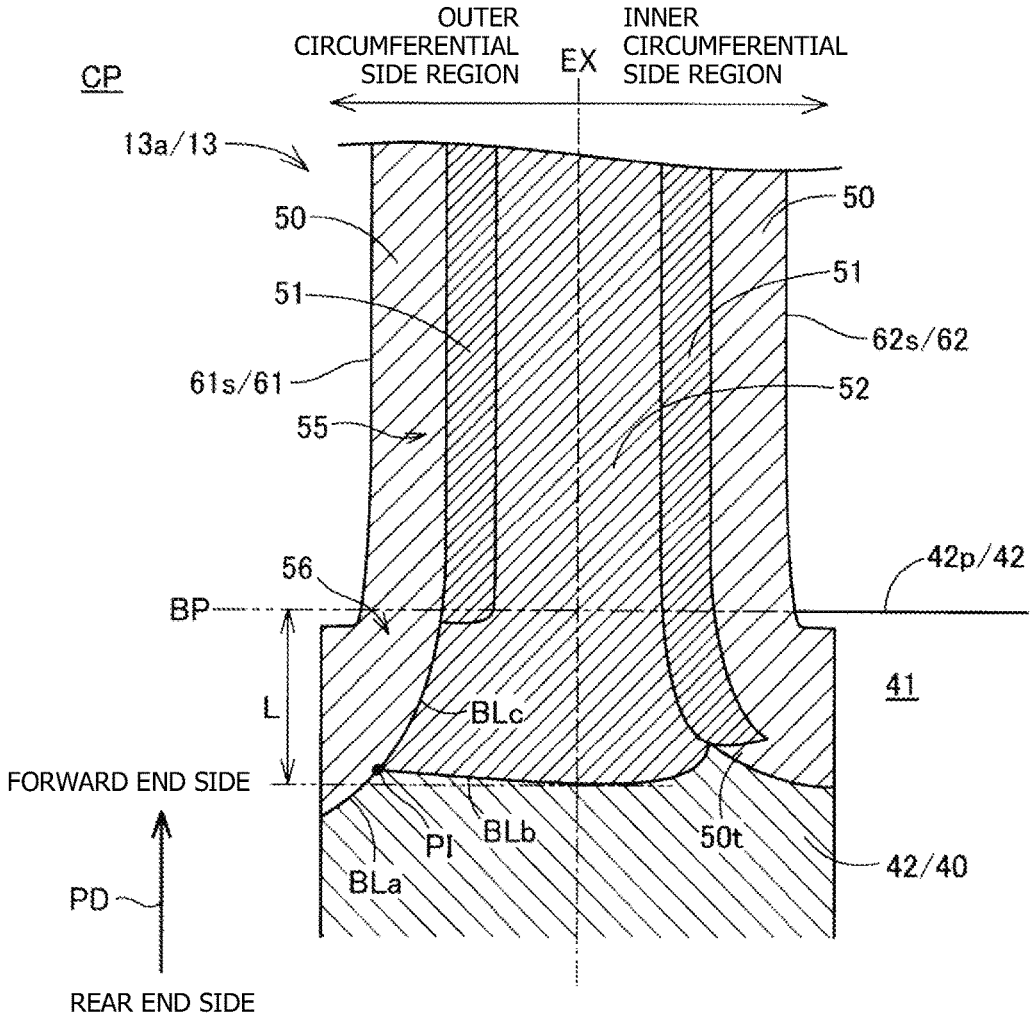
FIG. 7 is a schematic view showing another structural example of the juncture portion in the first embodiment.
Figure 8:
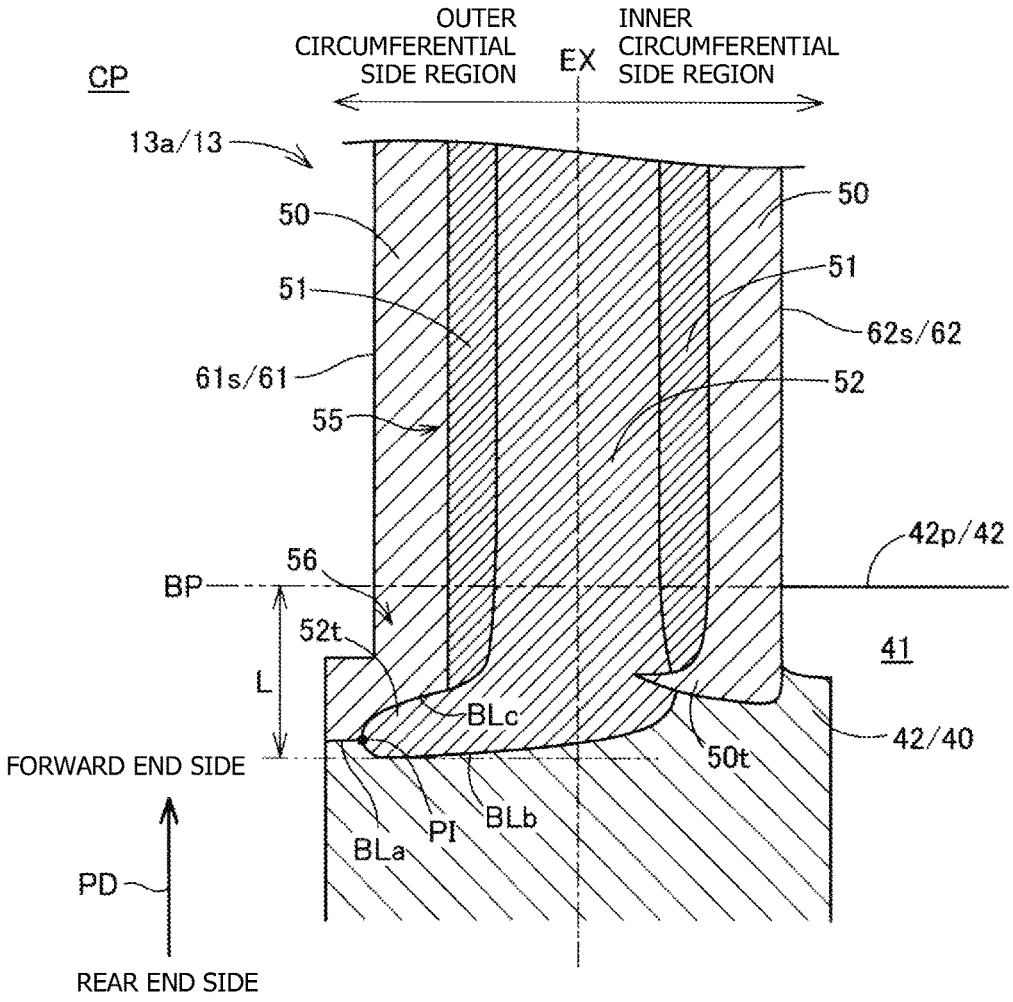
FIG. 8 is a schematic view showing another structural example of the juncture portion in the first embodiment.

Other structural examples of the juncture portion between the ground electrode 13 and the metallic shell 40 in the first embodiment will be described with reference to FIGS. 6 to 8. Each of FIGS. 6 to 8 schematically shows an example of the cross section of the juncture portion between the ground electrode 13 and the metallic shell 40. The cross section shown in each of FIGS. 6 to 8 is the center cross section CP which contains the center axis EX of the base end portion 13*a* of the ground electrode 13 and the center axis PX (not shown) of the spark plug 10.

The sectional structure shown in FIG. 6 is substantially the same as the sectional structure shown in FIG. 3 except that the first boundary line BLa extends straight from the intersection point PI along a direction orthogonal to the center axis EX. The sectional structure shown in FIG. 7 is substantially the same as the sectional structure shown in FIG. 3 except that the first outer surface 61 and the second outer surface 62 of the skin portion 50 do not have the curved portions 61*c* and 62*c* and have portions which are connected to the straight portions 61*s* and 62*s* through respective bent portions and extend along the direction orthogonal to the center axis EX. Even in the case where the juncture portion has the structure shown in FIG. 6 or FIG. 7, since at least one intersection point PI is present in the center cross section CP, the strength of welding between the ground electrode 13 and the metallic shell 40 is increased as in the case having been described with reference to FIG. 3.

In the sectional structure of the center cross section CP shown in FIG. 8, in the outer circumferential side region, an end portion of the skin portion 50 is bent in the direction orthogonal to the center axis EX, and an end portion 52*t* of the core portion 52 on the rear end side extends such that the end portion 52*t* intervenes between the skin portion 50 and the metallic shell 40 along the boundary therebetween. Also, in the inner circumferential side region, an end portion 50*t* of the skin portion 50 extends to intrude into the core portion 52. Notably, in this structural example, the boundary line between the core portion 52 and the skin portion 50 which is present in the inner circumferential side region does not extend toward the surface side from the rear-end-side end portion of the boundary line between the skin portion 50 and the intermediate portion 51, and therefore does not correspond to the third boundary line BLc. In such a structure as well, since at least one intersection point PI is present in the center cross section CP, the strength of welding between the ground electrode 13 and the metallic shell 40 is increased as in the case having been described with reference to FIG. 3.

Summary of the First Embodiment

As described above, in the spark plug 10 of the first embodiment, the heat resistance of the ground electrode 13 is enhanced by providing the intermediate portion 51 in the ground electrode 13. Also, the constituent material of the intermediate portion 51 and external foreign substances are restrained from existing at the welding interface between the ground electrode 13 and the metallic shell 40. Therefore, the strength of welding of the ground electrode 13 to the metallic shell 40 is increased. Furthermore, the spark plug 10 of the first embodiment can achieve various actions and effects explained in the description of the embodiment.

B. Second Embodiment

Structure of the Juncture Portion of the Ground Electrode

Figure 9:
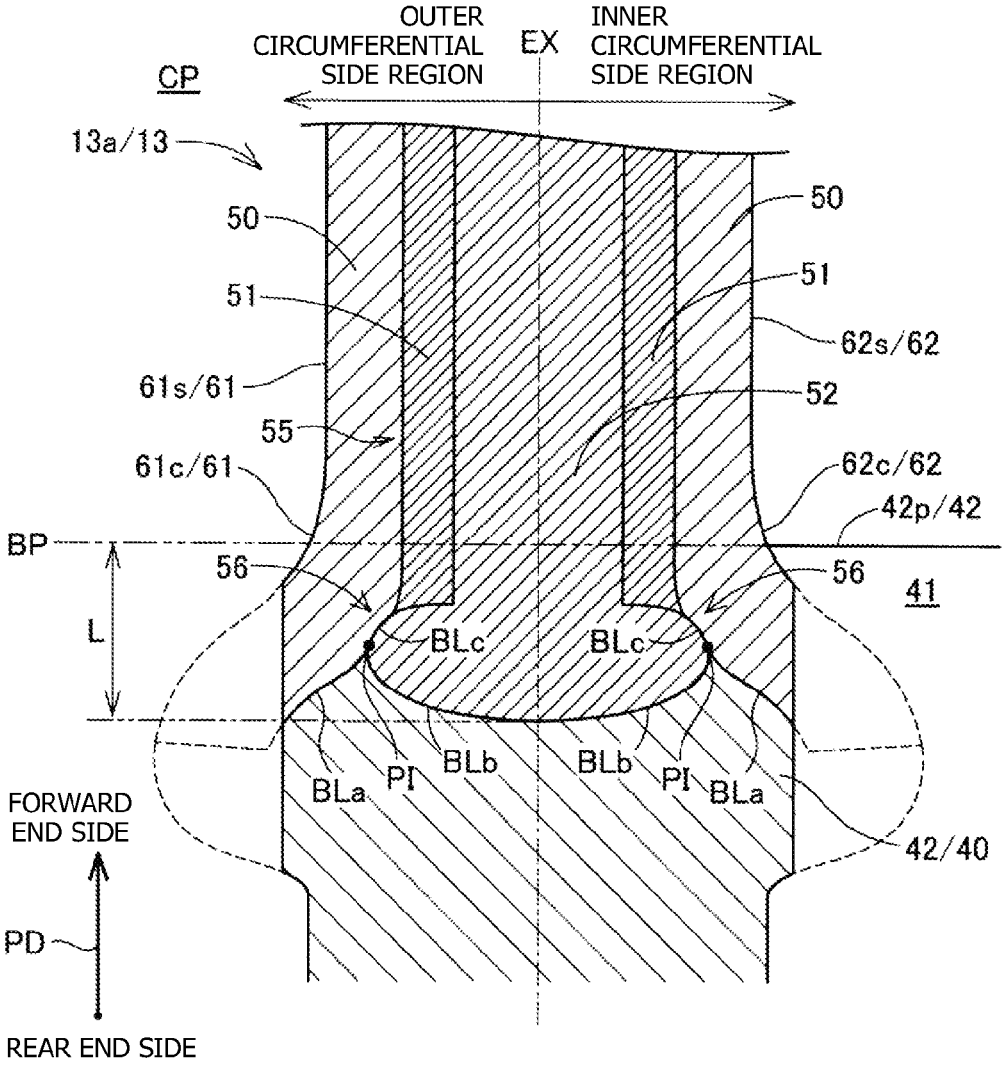
FIG. 9 is a schematic sectional view of a juncture portion between a ground electrode and a metallic shell in a second embodiment.

FIG. 9 schematically shows a cross sectional view of the juncture portion between the ground electrode 13 and the metallic shell 40 in a spark plug 10 of the second embodiment of the present invention. The structure of the spark plug 10 of the second embodiment is substantially the same as that of the spark plug 10 of the first embodiment except that the structure of the juncture portion of the spark plug 10 of the second embodiment differs from that of the juncture portion of the spark plug 10 of the first embodiment as described below. The cross section shown in FIG. 9 is the center cross section CP which contains the center axis EX of the base end portion 13*a* of the ground electrode 13 and the center axis PX (not shown) of the spark plug 10, as described in the first embodiment. Notably, in FIG. 9, the bulges of the juncture portion removed after the welding process are depicted by broken lines.

In the spark plug 10 of the second embodiment, in both the outer circumferential side region and the inner circumferential side region, the rear end portion of the skin portion 50 expands in a direction away from the center axis EX such that the distance between the center axis EX and the rear end portion increases toward the rear end side. Further, a rear end portion of the core portion 52 greatly bulges toward the outer and inner circumferential sides and is in contact with the skin portion 50. Even in the spark plug 10 of the second embodiment, in the center cross section CP, the second multilayer portion 56 in which the skin portion 50 and the core portion 52 are in direct contact with each other is formed on the rear end side of the first multilayer portion 55.

Also, in the spark plug 10 of the second embodiment, at least two intersections PI are formed in the second multilayer portion 56 in the center cross section CP. The two intersection points PI are located on opposite sides of the center axis EX of the base end portion 13*a*. The first intersection point PI is located in the outer circumferential side region, and the second intersection point PI is located in the inner circumferential side region. As described above, in the spark plug 10 of the second embodiment, the constituent material of the intermediate portion 51, etc. are restrained from existing at the welding interface in both the outer circumferential side region and the inner circumferential side region, whereby the welding strength is increased further.

In the spark plug 10 of the second embodiment, two first boundary lines BLa extend toward the rear end side from the two intersection points PI such that the distances between the first boundary lines BLa and the center axis EX increase toward the rear end side. According, in both the outer circumferential side region and the inner circumferential side region, the strength of welding of the skin portion 50 to the metallic shell 40 is increased.

In addition, in the spark plug 10 of the second embodiment, in the center cross section CP, the second boundary line BLb, which is the boundary line between the rear end portion of the core portion 52 and the metallic shell 40, is curved toward the metallic shell 40 side. More specifically, the second boundary line BLb bulges into a curved shape to depict a curved line which is convex toward the metallic shell 40 side. As a result, as compared with the case where the second boundary line BLb is flat, the area of contact between the core portion 52 and the metallic shell 40 increases and thus the strength of welding between the core portion 52 and the metallic shell 40 is increased.

Also, in the spark plug 10 of the second embodiment, in the center cross section CP, the rear end portion of the core portion 52 bulges outward toward the intersection point PI in the outer circumferential side region and bulges inward toward the intersection point PI in the inner circumferential side region. More specifically, in both the outer circumferential side region and the inner circumferential side region, the outline of the rear end portion of the core portion 52 is convex toward the corresponding intersection point PI as a result of the second boundary line BLb depicting a curved line convex toward the rear end side and the third boundary line BLc depicting a curved line convex toward the forward end side. As a result, the area of contact between the core portion 52 and the metallic shell 40 increases further, whereby the strength of welding between the core portion 52 and the metallic shell 40 is increased further.

In the spark plug 10 of the second embodiment as well, as having been described in the first embodiment, it is desired that the welding depth L—which is the maximum value of the distance between the imaginary straight line representing the imaginary plane BP and the boundary line between the ground electrode 13 and the metallic shell 40—be greater than 0 mm and not greater than 1.2 mm. Also, it is desired that each of the curved portions 61*c* and 62*c* of the skin portion 50 have a curvature radius of 0.5 mm or greater.

Step of Joining the Ground Electrode

Figures 10A, 10B, 10C:
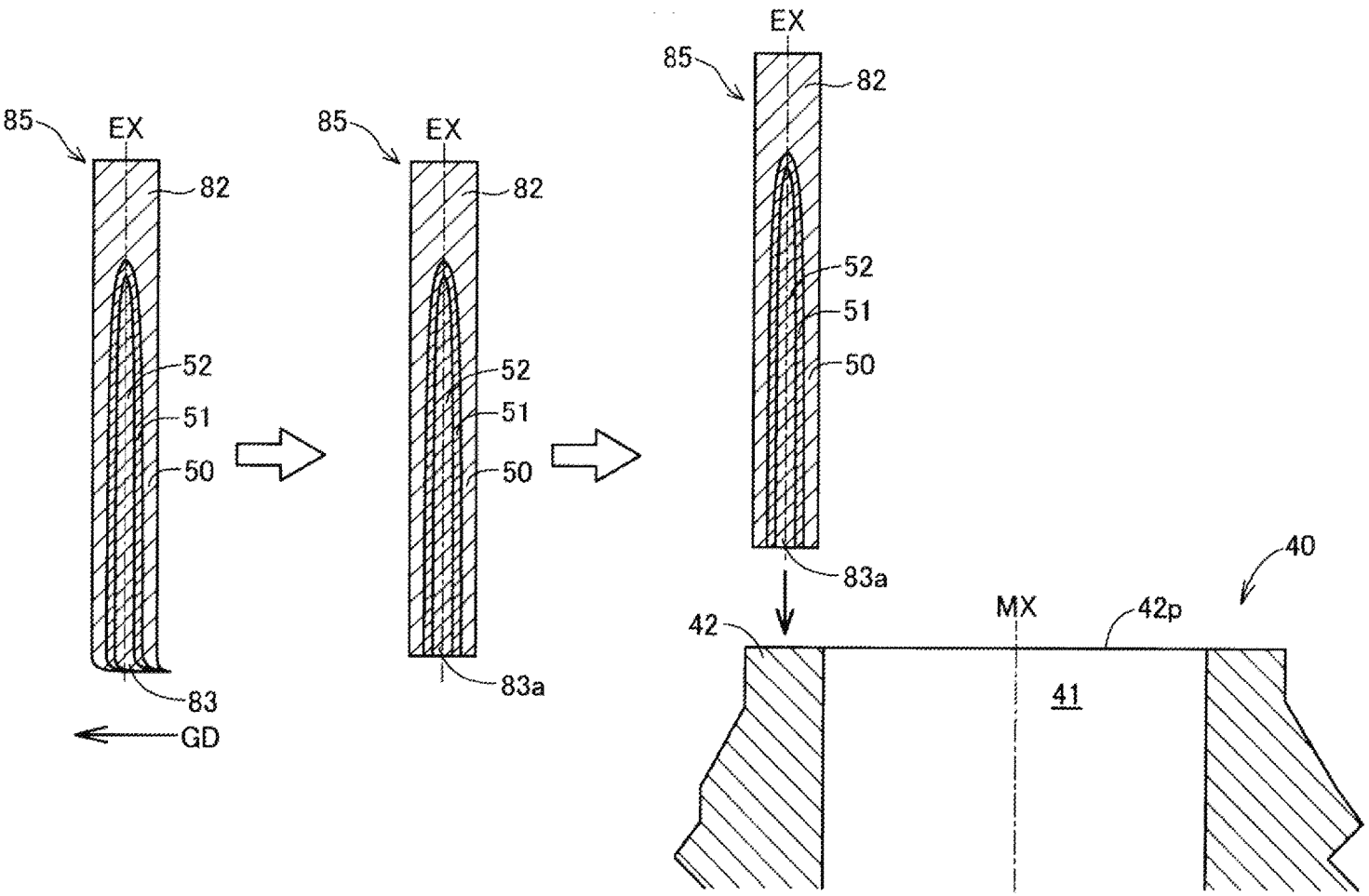
FIGS. 10(*a*), 10(*b*) and 10(*c*) are explanatory views schematically showing steps for welding the ground electrode base material in the second embodiment.

FIG. 10 is a set of explanatory views showing the steps of welding the ground electrode base material 85 in the second embodiment. The ground electrode base material 85 (section (a) of FIG. 10) is prepared by steps similar to the steps described in the first embodiment (FIG. 4). In the steps of welding the ground electrode base material 85 in the second embodiment, before welding, machining work is performed so as to remove the distortion of the layered structure of the rear end portion 83 of the ground electrode base material 85 (section (b) of FIG. 10). Specifically, polishing work is performed such that its main polishing direction coincides with a direction (the direction of an arrow GD) opposite the direction of the cutting by which the ground electrode base material 85 is prepared.

Subsequently, the machined rear end portion 83*s* is brought into contact with the open end 42 of the metallic shell 40 on the forward end side, and resistance welding is performed (section (c) of FIG. 10). In this resistance welding, as described in the first embodiment, the magnitude of the current, the current supply time, etc. are controlled such that the constituent material of the melted intermediate portion 51 does not flow out to the outside beyond the skin portion 50 and the skin portion 50 is gently deformed to form curved portions 61*c* and 62*c*. As described above, in the second embodiment, the distortion of the layered structure of the rear end portion 83 of the ground electrode base material 85 is removed. Therefore, the rear end portion 50*t* of the skin portion 50 is restrained from entering the core portion 52.

After the resistance welding, as having been described in the first embodiment, bulges of the juncture portion formed as result of the resistance welding are removed by, for example, cutting work or polishing work. Subsequently, after a plating step, etc., the ground electrode base material 85 is bent toward the center axis MX of the metallic shell 40.

Other Structural Examples of the Second Embodiment

Figure 11:
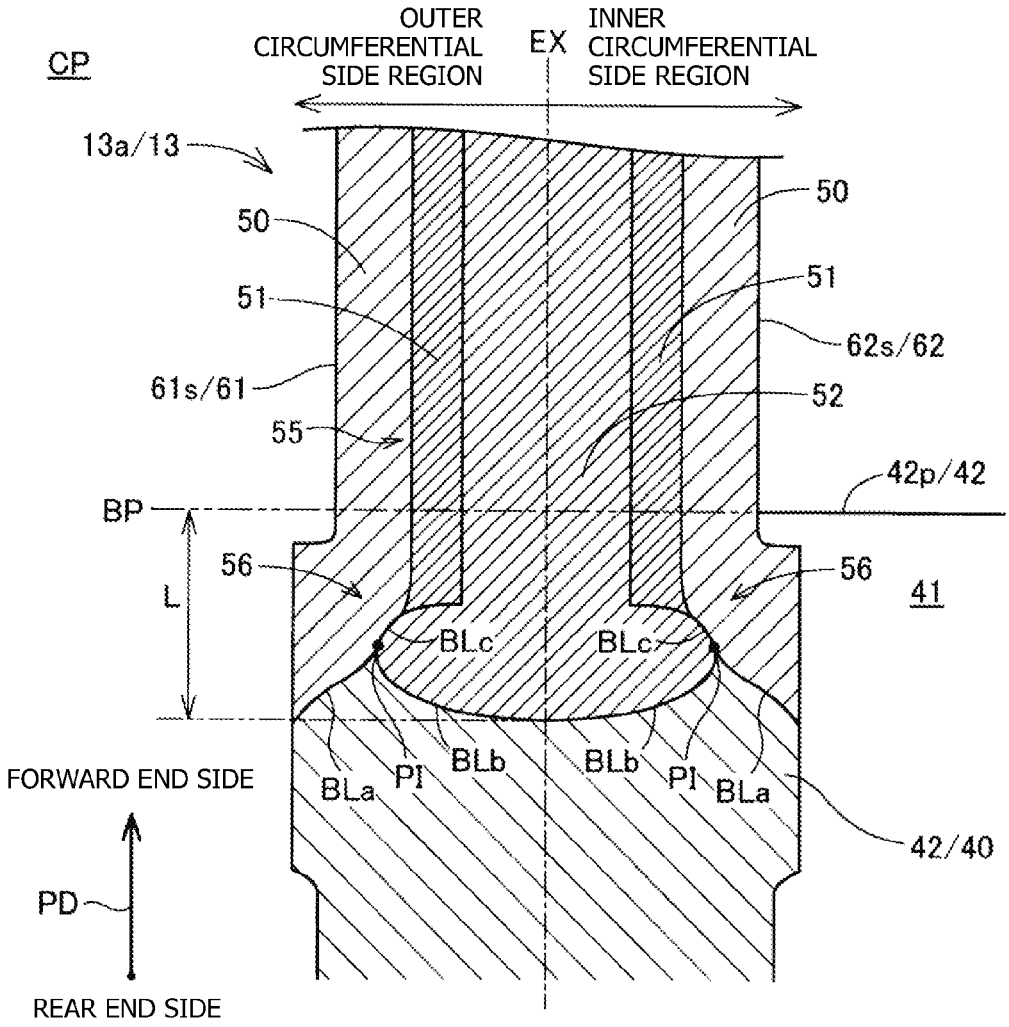
FIG. 11 is a schematic view showing another structural example of the juncture portion in the second embodiment.
Figure 12:
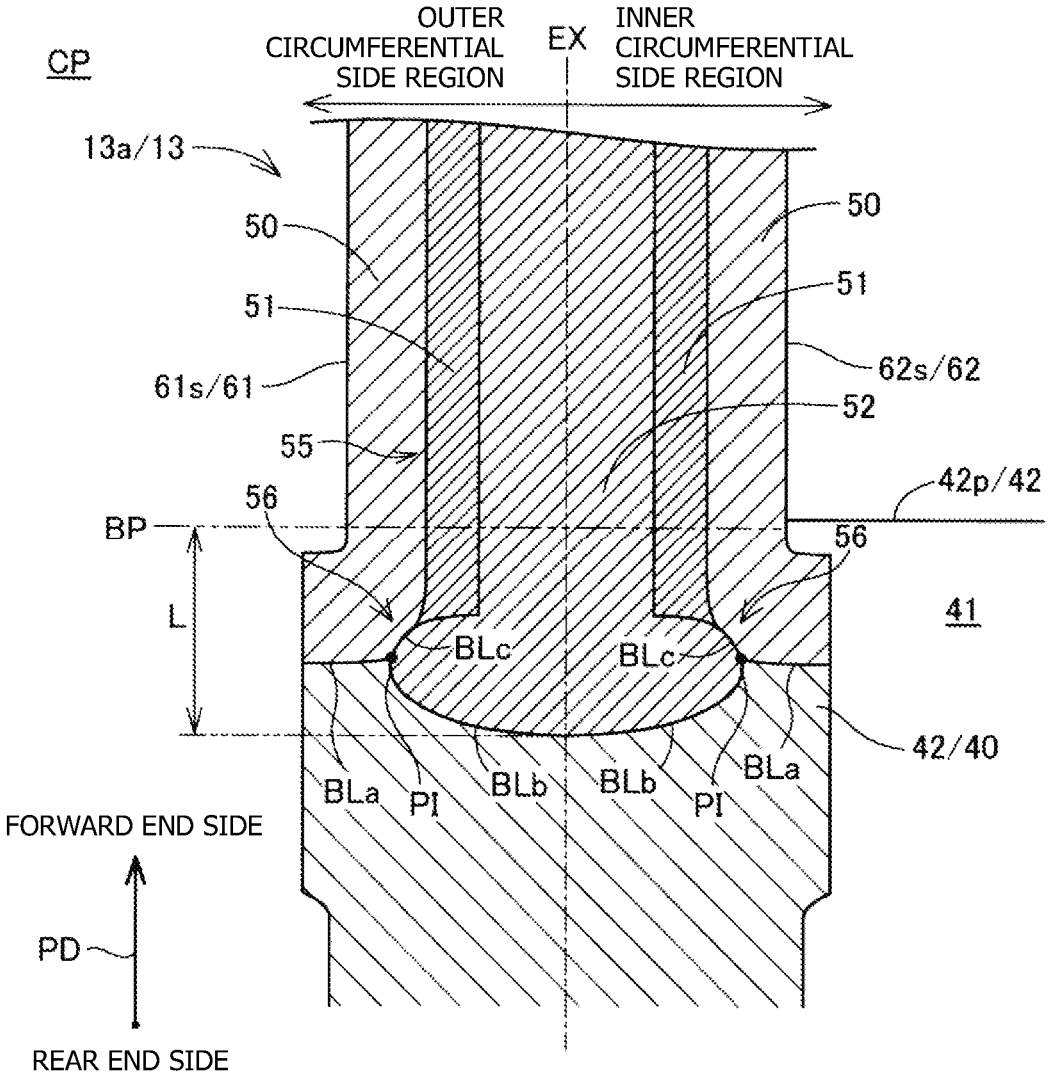
FIG. 12 is a schematic view showing another structural example of the juncture portion in the second embodiment.
Figure 13:
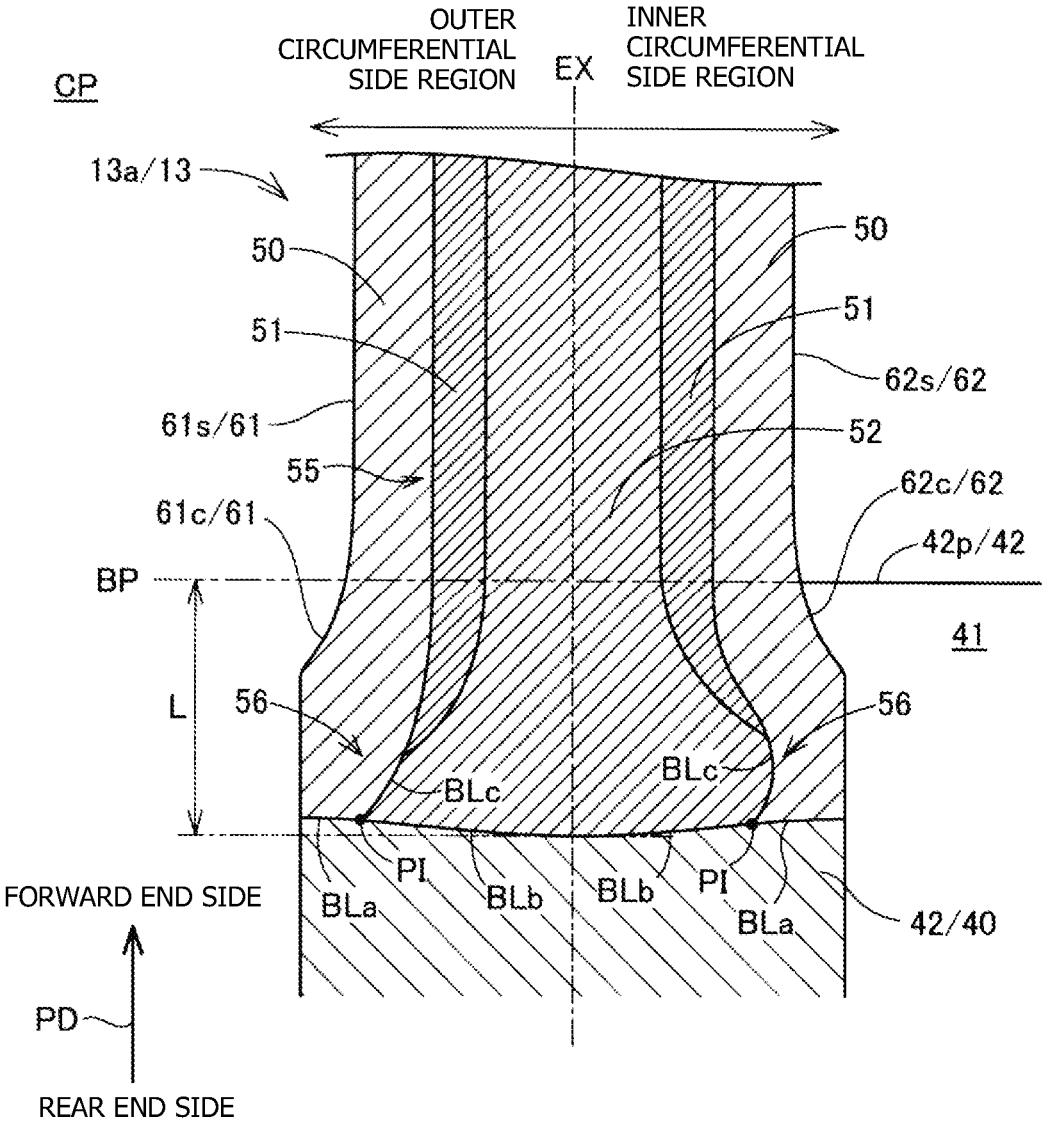
FIG. 13 is a schematic view showing another structural example of the juncture portion in the second embodiment.
Figure 14A:
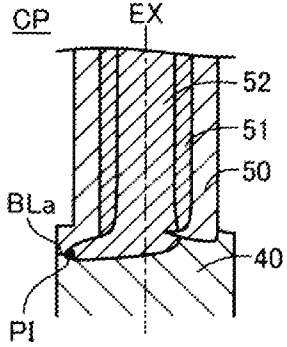
FIGS. 14(A), 14(B), 14(C), 14(D), 14(E), 14(F), 14(G), 14(H) and 14(Z) are explanatory views showing the types of the sectional structure of the juncture portion of the ground electrode.
Figure 14B:
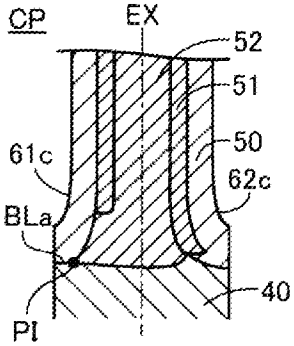
Figure 14C:
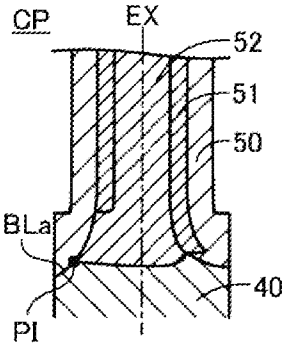
Figure 14D:
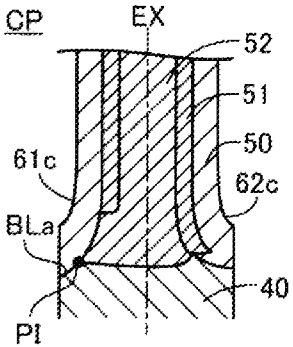
Figure 14E:
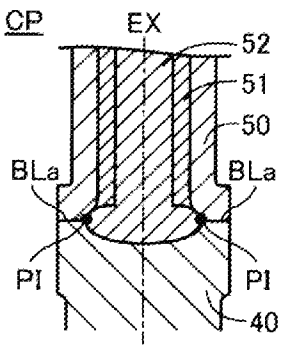
Figure 14F:
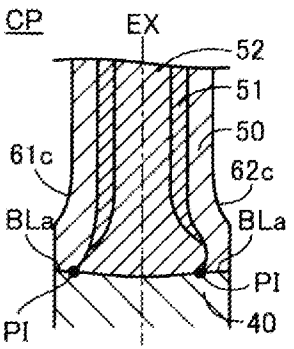
Figure 14G:
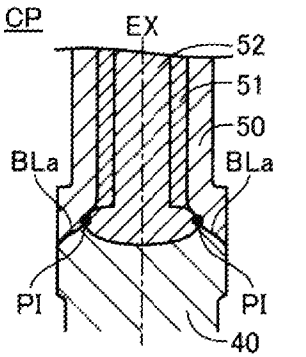
Figure 14H:
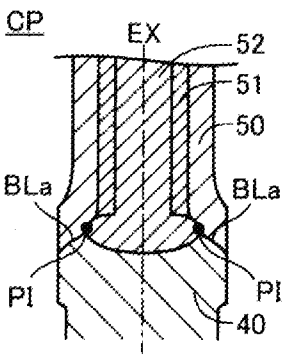
Figure 14Z:
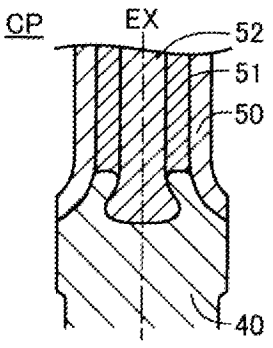

Other structural examples of the juncture portion between the ground electrode 13 and the metallic shell 40 described in the second embodiment will be described with reference to FIGS. 11 to 13. Each of FIGS. 11 to 13 schematically shows an example of the cross section of the juncture portion between the ground electrode 13 and the metallic shell 40. The cross section shown in each of FIGS. 11 to 13 is the center cross section CP which contains the center axis EX of the base end portion 13*a* of the ground electrode 13 and the center axis PX (not shown) of the spark plug 10.

The sectional structure shown in FIG. 11 is substantially the same as the sectional structure shown in FIG. 9 except that the first outer surface 61 and the second outer surface 62 of the skin portion 50 do not have the curved portions 61*c* and 62*c* and have portions which are connected to the straight portions 61*s* and 62*s* through respective bent portions and extend along the direction orthogonal to the center axis EX. The sectional structure shown in FIG. 12 is substantially the same as the sectional structure shown in FIG. 11 except that the first boundary lines BLa extend from the two intersection points PI along a direction orthogonal to the center axis EX. Even in the case where the juncture portion has the sectional structure shown in FIG. 11 or FIG. 12, since two intersection points PI are present at least in the center cross section CP, the strength of welding between the ground electrode 13 and the metallic shell 40 is increased as in the case having been described with reference to FIG. 9.

The cross section of the juncture portion shown in FIG. 13, the first boundary lines BLa and the second boundary line BLb constitute a continuous and smooth curved line extending along the direction orthogonal to the center axis EX. Also, in the inner circumferential side region, the inner surface of the skin portion 50 on the center axis EX side curves toward the center axis EX at the rear end of the skin portion 50. In such a structure as well, since two intersection points PI are present in the center cross section CP, the strength of welding between the ground electrode 13 and the metallic shell 40 is increased as in the case having been described with reference to FIG. 9.

Summary of the Second Embodiment

As described above, in the spark plug 10 of the second embodiment, the ground electrode 13 and the metallic shell 40 are welded to each other such that two intersection points PI are produced on the opposite sides of the center axis EX at least in the center cross section CP, whereby the strength of welding between the ground electrode 13 and the metallic shell 40 is increased. Furthermore, the spark plug 10 of the second embodiment can achieve various actions and effects similar to the actions and effects explained in the description of the first embodiment.

C. Experimental Examples

Experimental examples 1 through 5 regarding the juncture portions of the ground electrodes 13 having various sectional structures described in the embodiments will be described with reference to FIGS. 14 through 26. In the experimental examples 1 through 5, various types of tests for evaluating the reliability of joining were carried out for samples in each of which the ground electrode base material 85 had been welded to the metallic shell 40 and the ground electrode base material 85 had not yet been bent.

Manufacturing Conditions of Each Sample

In each sample, the metallic shell 40 was formed of carbon steel, the skin portion 50 of the ground electrode base material 85 was formed of NCF601, the intermediate portion 51 of the ground electrode base material 85 was formed of Cu, and the core portion 52 of the ground electrode base material 85 was formed of Ni. Also, the conditions of energization control during resistance welding, the conditions of machining the rear end portion of the ground electrode base material 85, etc. were changed among the samples such that the samples had different sectional structures in the juncture portion of the ground electrode base material 85.

Types of the Sectional Structure in the Experimental Examples

The table of FIG. 14 shows the types of the sectional structure of the center cross section CP observed at the juncture portion of the ground electrode base material 85 in the samples tested in the experimental examples 1 through 5. The types A through D correspond to the sectional structures described in the first embodiment, and the types E through H correspond to the sectional structures described in the second embodiment. The specific correspondences between the types A through H and the sectional structures described in the embodiments are as follows.

Type A: the sectional structure of FIG. 8 (a variation of the first embodiment)

Type B: the sectional structure of FIG. 6 (a variation of the first embodiment)

Type C: the sectional structure of FIG. 7 (a variation of the first embodiment)

Type D: the sectional structure of FIG. 3 (the structure of the first embodiment)

Type E: the sectional structure of FIG. 12 (a variation of the second embodiment)

Type F: the sectional structure of FIG. 13 (a variation of the second embodiment)

Type G: the sectional structure of FIG. 11 (a variation of the second embodiment)

Type H: the sectional structure of FIG. 9 (the structure of the second embodiment)

The type Z corresponds to the sectional structure of the center cross section observed in a reference example. In the center cross section CP of the reference example, in both the outer circumferential side region and the inner circumferential side region, a portion of the constituent material of the metallic shell 40 intervenes between the core portion 52 and the skin portion 50 and is in direct contact with the intermediate portion 51. Therefore, the center cross section CP of the reference example have no intersection point PI at which three boundary lines BLa through BLc meet as having described in the embodiments.

Details of a Test Regarding the Reliability of Joining

In each of the experimental examples 1 through 5, any one of (a) a welding strength evaluation test, (b) a breakage strength evaluation test, (c) a shell state evaluation test, and (d) an oxidation resistance evaluation test was carried out as a test for evaluating the reliability of joining of the ground electrode base material 85. The specific procedure of each test is as follows.

(a) Welding Strength Evaluation Test:

An operation of bending a portion of the ground electrode base material 85 on the forward end side toward the center axis MX of the metallic shell 40 by an angle of about 90 degrees and bending that portion back to the straight state was repeated until the ground electrode base material 85 fractured, and the number of times of the bending operation before occurrence of fracture was counted. Notably, the position at which the ground electrode base material 85 was bent was set to a position shifted from the rear-end-side end portion (the juncture portion) of the ground electrode base material 85 toward the forward end side by about 1 mm. One was added to the number of times of bending the ground electrode base material 85 when the ground electrode base material 85 was bent toward the center axis MX by the angle of about 90 degrees, and one was added to the number of times of bending when the ground electrode base material 85 was bent back to the straight state.

(b) Breakage Strength Evaluation Test:

A weight of 50 g was attached to the forward end portion of the ground electrode base material 85, vibration was applied under the following conditions, and the time elapsed before the ground electrode base material 85 fractured was measured.

Vibration Conditions

Frequency: 50 Hz-200 Hz

Frequency variation period (time over which the frequency is changed from the upper limit to the lower limit or is changed from the lower limit to the upper limit): 0.5 min Acceleration: 5 G (c) Shell State Evaluation Test:

Presence or absence of a region where Cu (the constituent material of the intermediate portion 51) intruded into the metallic shell 40 was visually checked in the center cross section CP of each sample.

(d) Oxidation Resistance Evaluation Test:

A temperature load was applied to each sample by subjecting each sample to a predetermined number of temperature cycles in which each sample was periodically and alternatingly placed in a high temperature environment and a low temperature environment, and a change in the width of the ground electrode base material 85 between a point before the application of the temperature load and a point after application of the temperature load was inspected. More specifically, a temperature load was applied to each sample under the following conditions, and the ratio (T2/T1) of the width T2 of the ground electrode base material 85 after the application of the temperature load to the width T1 of the ground electrode base material 85 before the application of the temperature load was obtained.

Conditions of the Temperature Load

Temperature of the high temperature environment and exposure time: 1100° C., 2 minutes Temperature of the low temperature environment and exposure time: room temperature (about 20° C.), 1 minute Number of cycles during which the temperature load was applied: 10,000 cycles

Experimental Example 1

FIG. 15 is an explanatory view showing a table in which the test results of Experimental example 1 are summarized. In Experimental example 1, the welding strength evaluation test was performed for the following three samples; i.e., Samples S11 through S13. Sample S11 had a sectional structure of the type Z and its center cross section CP did not contain the intersection point PI described in the embodiments. Sample S12 had a sectional structure of the type A and one intersection point PI was present in the center cross section CP. Sample S13 had a sectional structure of the type E and two intersection points PI were present in the center cross section CP.

The test results obtained in Experimental example 1 show that Sample S13 was the highest in welding strength, Sample S12 was the second highest in welding strength, and Sample S11 was the lowest in welding strength. These test results reveal that when at least one intersection point PI is present in the center cross section CP, the welding strength is increased, and when the intersection point PI is present on the opposite sides of the center axis EX, the welding strength is increased further.

Experimental Example 2

FIG. 16 is an explanatory view showing a table in which the test results of Experimental example 2 are summarized. In Experimental example 2, the welding strength evaluation test was carried out for the following four samples; i.e., Samples S21 through S24. Sample S21 had a sectional structure of the type B, and the first boundary line BLa in its center cross section CP extended from the intersection point PI in the direction orthogonal to the center axis EX. In contrast, Sample S22 had a sectional structure of the type D, and the first boundary line BLa in its center cross section CP extended from the intersection point PI toward the rear end side such that the distance between the first boundary line BLa and the center axis EX increased toward the rear end side.

Sample S23 had a sectional structure of the type F, and the first boundary lines BLa in its center cross section CP extended from the two intersection points PI along the direction orthogonal to the center axis EX. In contrast, Sample S24 had a sectional structure of the type H, and the first boundary lines BLa in its center cross section CP extended from the two intersection points PI toward the rear end side such that the distances between the first boundary lines BLa and the center axis EX increased toward the rear end side.

The test results show that Sample S22 was higher in welding strength than Sample S21. Also, the test results show that Sample S24 was higher in welding strength than Sample S23. As described above, in the case where the first boundary line(s) BLa extends toward the rear end side such that the distance(s) between the first boundary line(s) BLa and the center axis EX increases toward the rear end side, the welding strength is higher as compared with the case where the first boundary line(s) BLa extends along the direction orthogonal to the center axis EX. Also, like the test results in Experimental example 1, the test results in Experimental example 2 show that Samples S23 and S24 having two intersection points PI were higher in welding strength than Samples S21 and S22 having a single intersection point PI.

Experimental Example 3

FIG. 17 is an explanatory view showing a table in which the test results of Experimental example 3 are summarized. In Experimental example 3, the breakage strength evaluation test was carried out for the following three samples; i.e., Samples S31 through S33. Sample S31 had a sectional structure of the type G, and the first outer surface 61 and the second outer surface 62 of the skin portion 50 did not have the curved portions 61*c* and 62*c*. In contrast, Samples S32 and S33 had a sectional structure of the type H, and the first outer surface 61 and the second outer surface 62 of the skin portion 50 had the curved portions 61*c* and 62*c*. Whereas the curved portions 61*c* and 62*c* of Sample S32 had a curvature radius less than 0.5 mm, the curved portions 61*c* and 62*c* of Sample S33 had a curvature radius equal to or greater than 0.5 mm.

The test results obtained in Experimental example 3 show that, as compared with Sample S31 in which the skin portion 50 did not have the curved portions 61*c* and 62*c*, Samples S32 and S33 in which the skin portion 50 had the curved portions 61*c* and 62*c* restricted fracture of the ground electrode base material 85 to a greater degree and had higher strength against breakage. In the case of Sample S32 in which the curved portions 61*c* and 62*c* had a curvature radius less than 0.5 mm, the ground electrode base material 85 fractured within 20 to 60 minutes after the start of the test. In contrast, in the case of Sample S33 in which the curved portions 61*c* and 62*c* had a curvature radius equal to or greater than 0.5 mm, the ground electrode base material 85 did not fracture within 60 minutes after the start of the test. These test results reveal that it is desired that the curved portions 61*c* and 62*c* have a curvature radius equal to or greater than 0.5 mm.

Experimental Example 4

FIG. 18 is an explanatory view showing a table in which the test results of Experimental example 4 are summarized.

In Experimental example 4, the welding strength evaluation test and the shell state evaluation test were carried out for samples having different sectional structures and different welding depths L. In the sample number of each sample in Experimental example 4, the two-digit number following the symbol "S" corresponds to the type of the sectional structure, and the final number after the hyphen shows that the greater its value the greater the welding depth L.

Each of Samples S41-1 through S41-5 had a sectional structure of the type B and each of Samples S42-1 through S42-5 had a sectional structure of the type C. In each of Samples S41-1 through S41-5 and Samples S42-1 through S42-5, a single intersection point PI was present in the center cross section CP. Each of Samples S43-1 through S43-5 had a sectional structure of the type E and each of Samples S44-1 through S44-5 had a sectional structure of the type G. In each of Samples S43-1 through S43-5 and Samples S44-1 through S44-5, two intersection points PI were present in the center cross section CP.

The results of the welding strength evaluation test performed in Experimental example 4 show that in each of sample groups having different types of sectional structures, the welding strength increased with the welding depth L when the welding depth L was within the range of 0 to 1.2 mm. Also, the results of the shell state evaluation test performed in Experimental example 4 shows that in each of sample groups having different types of sectional structures, intrusion of Cu from the ground electrode base material 85 into the metallic shell 40 was not observed when the welding depth L was within the range of 0 to 1.2 mm. These test results reveal that the welding depth L is desirable to be greater than 0 mm, more desirable to be 0.2 mm or greater, and particularly desirable to be 0.4 mm or greater.

Meanwhile, the results of the welding strength evaluation test performed in Experimental example 4 show that the samples in which the welding depth L was 1.5 mm had the same welding strength as the samples in which the welding depth L was 1.2 mm. Also, in the shell state evaluation test, intrusion of Cu from the ground electrode base material 85 into the metallic shell 40 was observed in the samples in which the welding depth L was 1.5 mm. These test results reveal that it is preferred that the welding depth L be smaller than 1.5 mm and it is more preferred that the welding depth L be equal to or smaller than 1.2 mm.

In the welding strength evaluation test performed in Experimental example 4, for the samples having the same welding depth L, the same results as those obtained in the above-described Experimental example 1 were obtained. Namely, the samples having two intersection points PI in the center cross section CP exhibit higher welding strength than the samples having a single intersection point PI in the center cross section CP. Also, for the samples having the same welding depth L and the same number of intersection point(s) PI in the center cross section CP, the same results as those obtained in the above-described Experimental example 2 were obtained. Namely, the sample in which the first boundary line(s) BLa extends toward the rear end side such that the distance between the first boundary line(s) BLa and the center axis EX increases toward the rear end side exhibits higher welding strength than the sample in which the first boundary line(s) BLa extends along the direction orthogonal to the center axis EX.

Experimental Example 5

FIGS. 19 through 26 are explanatory views showing tables in which the test results of Experimental example 5 are summarized. In Experimental example 5, the welding strength evaluation test and the oxidation resistance evaluation test were carried out for samples having different sectional structures, different welding depths L, and different Al contents in the skin portion 50. Each of FIGS. 19 through 26 shows a table for a group of samples which are the same in the two-digit number of the sample number following the symbol "S" thereof.

In the sample number of each sample in Experimental example 5, when samples have the same two-digit number following the symbol "S," the sectional structures of these samples are of the same type. Samples whose sample numbers start with "S51" have a sectional structure of the type A (FIG. 19); samples whose sample numbers start with "S52" or "S53" have a sectional structure of the type B (FIGS. 20 and 21); and samples whose sample numbers start with "S54" have a sectional structure of the type D (FIG. 22).

Samples whose sample numbers start with "S55" have a sectional structure of the type E (FIG. 23); samples whose sample numbers start with "S56" or "S57" have a sectional structure of the type F (FIGS. 24 and 25); and samples whose sample numbers start with "S58" have a sectional structure of the type H (FIG. 26). Notably, although the group of samples whose sample numbers start with "S52" (FIG. 20) and the group of samples whose sample numbers start with "S53" (FIG. 21) are the same in terms of the sectional structure type, these groups differ from each other in terms of the curvature radius of the curved portions 61*c* and 62*c*. The same is true for the group of samples whose sample numbers start with "S56" (FIG. 24) and the group of samples whose sample numbers start with "S57" (FIG. 25).

The samples tested in Experimental example 5 have different welding depths. Namely, in samples whose sample numbers end with "1," "2," or "3," the welding depth L is greater than 0 and less than 0.2 mm. In samples whose sample numbers end with "4," "5," or "6," the welding depth L is 0.2 mm. In samples whose sample numbers end with "7," "8," or "9," the welding depth L is 0.4 mm. In samples whose sample numbers end with "10," "11," or "12," the welding depth L is 1.2 mm. In samples whose sample numbers end with "1," "4," "7," or "10," the Al content of the skin portion 50 is 0 wt. %. In samples whose sample numbers end with "2," "5," "8," or "11," the Al content of the skin portion 50 is 2.5 wt. %. In samples whose sample numbers end with "3," "6," "9," or "12," the Al content of the skin portion 50 is 5.0 wt. %.

The results of the oxidation resistance evaluation test performed in Experimental example 5 show that, irrespective of the sectional structure type and the welding depth L, the value of T2/T1 became 0.5 or greater when the Al content of the skin portion 50 was greater than 0 wt. %. The greater the amount by which the width of the ground electrode base material 85 decreased as a result of a temperature load, the smaller the value of T2/T1. Namely, the results in Experimental example 5 show that when the ground electrode base material 85 is formed such that the Al content of the skin portion 50 is greater than 0 wt. %, a change in its shape due to a temperature load is suppressed, and its durability is enhanced. Conceivably, these advantage effects are attained for the following reason. Since Al is contained in the skin portion 50, oxide film is formed on the first outer surface 61 and the second outer surface 62 of the skin portion 50, whereby the oxidation resistance of the ground electrode base material 85 is enhanced. These results reveal that the Al content of the skin portion 50 is desirably greater than 0 wt. %.

Meanwhile, the results of the welding strength evaluation test performed in Experimental example 5 show that, irrespective of the sectional structure type and the welding depth L, the samples in which the Al content of the skin portion 50 was 2.5 wt. % had higher welding strength as compared with the samples in which the Al content of the skin portion 50 was 5.0 wt. %. Conceivably, the reason why an increase in the Al content of the skin portion 50 from 2.5 wt. % to 5.0 wt. % resulted in a decrease in welding strength is that oxygen atoms within the oxide film formed on the skin portion 50 migrate to the welding interface. These results reveal that the Al content of the skin portion 50 is desirably less than 5.0 wt. %, and is more desirably equal to or less than 2.5 wt. %.

Moreover, the results of the welding strength evaluation test performed in Experimental example 5 show the flowing. When the welding strengths of the samples having the same welding depth L and the same Al content in the skin portion 50 are compared with one another, there is found a tendency that the samples having two intersection points PI in the center cross section CP (FIGS. 23 through 26) are higher in welding strength than the samples having a single intersection point PI in the center cross section CP (FIGS. 19 through 22). Also, when the samples having the same welding depth L, the same Al content in the skin portion 50, and the same number of intersection points PI in the center cross section CP are compared with one another, it is found that the samples in which the first boundary line(s) BLa extends toward the rear end side such that the distance between the first boundary line(s) BLa and the center axis EX increases toward the rear end side (FIGS. 22 and 26) exhibit higher welding strength than the sample in which the first boundary line(s) BLa extends along the direction orthogonal to the center axis EX (FIGS. 19, 20, 21, 23, 24, and 25).

D. Modifications

D1. Modification 1:

In the above-described embodiments (including their variations. This applies to the description of modifications described below), the skin portion 50 is formed as the most outer layer of the ground electrode 13. However, a different material layer may be formed on the outer side of the skin portion 50 of the ground electrode 13. In the above-described embodiments, the layer of the skin portion 50 and the layer of the intermediate portion 51 are formed to be located adjacent to each other, and the layer of the intermediate portion 51 and the layer of the core portion 52 are formed to be located adjacent to each other. However, a different material layer may be interposed between the layer of the skin portion 50 and the layer of the intermediate portion 51 or between the layer of the intermediate portion 51 and the layer of the core portion 52.

D2. Modification 2:

In the above-described embodiments, there is described a structure in which, in the center cross section CP, the first boundary line BLa extends toward the rear end side such that the distance between the first boundary line BLa and the center axis EX of the base end portion 13*a* increases toward the rear end side in both the outer circumferential side region and the inner circumferential side region. However, in the center cross section CP, the first boundary line BLa may extend toward the rear end side such that the distance between the first boundary line BLa and the center axis EX of the base end portion 13*a* increases toward the rear end side in only one of the outer circumferential side region and the inner circumferential side region.

D3. Modification 3:

In the above-described embodiments, there is described the structure in which, in the center cross section CP, the curved portions 61*c* and 62*c* are formed on the first outer surface 61 and the second outer surface 62, respectively, of the skin portion 50. However, in the center cross section CP, the curved portion is not required to be formed on both the first outer surface 61 and the second outer surface 62 of the skin portion 50, and the curved portion may be formed on only one of the first outer surface 61 and the second outer surface 62 of the skin portion 50. Also, in the case of the structure in which, in the center cross section CP, the skin portion 50 has the two curved portions 61*c* and 62*c*, only one of the curved portions 61*c* and 62*c* may have a curvature radius of 0.5 mm or greater. Notably, as exemplified in the structures of the variations described in each embodiment, the skin portion 50 is not required to have the curved portions 61*c* and 62*c* in the center cross section CP. However, the curved portions 61*c* and 62*c* are desirably formed on both the first outer surface 61 and the second outer surface 62 of the skin portion 50 in the center cross section CP, because the strength of the ground electrode 13 can be increased further.

D4. Modification 4:

In the above-described embodiments, in the center cross section CP, the second multilayer portion 56 in which the skin portion 50 and the core portion 52 are in direct contact with each other is formed in both the inner circumferential side region and the outer circumferential side region. However, the second multilayer portion 56 may be formed in at least one of the inner circumferential side region and the outer circumferential side region.

D5. Modification 5:

In the sectional structure of the second embodiment shown in FIG. 9, the second boundary line BLb, which is the boundary line between the core portion 52 and the metallic shell 40, is curved toward the metallic shell 40. However, the second boundary line BLb is not required to be curved and may be bent at the apex. Alternatively, the second boundary line BLb may form a plurality of convex portions projecting toward the metallic shell 40 side. In the sectional structure of the second embodiment shown in FIG. 9, in both the outer circumferential side region and the inner circumferential side region, the rear end portion of the core portion 52 bulges in the direction intersecting the center axis EX. However, the rear end portion of the core portion 52 may bulge in only one of the outer circumferential side region and the inner circumferential side region. Also, the rear end portion of the core portion 52 is not required to bulge in the direction intersecting the center axis EX, and the outline of the rear end portion of the core portion 52 may be bent at the apex.

D6. Modification 6:

The skin portion 50, the intermediate portion 51, and the core portion 52 in the above-described embodiments may be formed of metallic materials other than the materials specifically shown in the embodiments as examples. The skin portion 50 may be formed of a metallic material other than an Ni-based heat resisting alloy, the intermediate portion 51 may be formed of a metal other than Cu, and the core portion 52 may be formed of a material other than Ni.

The present invention is not limited to the above described embodiments, examples, and modifications and may be embodied in various other forms without departing from the spirit of the invention. For example, the technical features in the embodiments, examples, and modifications corresponding to the technical features in the modes described in Summary of the Invention can be appropriately replaced or combined to solve some of or all the foregoing problems or to achieve some of or all the foregoing effects. A technical feature which is not described as an essential feature in the present specification may be appropriately deleted.

DESCRIPTION OF REFERENCE NUMERALS AND SYMBOLS

10: spark plug
11: center electrode
11*e*: forward end portion
13: ground electrode
13*a*: base end portion
13*b*: distal end portion
14: tip portion
20: insulator
21: axial hole
30: terminal
31: rear end portion
35: resistor
36, 37: glass seal material
40: metallic shell
41: bore
42: open end
43: screw portion
45: tool engagement portion
47: crimped portion
50: skin portion
50*t*: end portion
51: intermediate portion
52: core portion
52*t*: end portion
55: first multilayer portion
56: second multilayer portion
61: first outer surface
61*s*: straight portion
61*c*: curved portion
62: second outer surface
62*s*: straight portion
62*c*: curved portion
70: first base material
71: core portion base material
72: intermediate portion base material
72*h*: bore
75: second base material
75*h*: bore
78: third base material
80: extended base material
81: forward-end-side portion
82: forward end portion
83, 83*a*: rear end portion
85: ground electrode base material
CP: center cross section
BLa, BLb, BLc: boundary line
PI: intersection point Having described the invention, the following is claimed:

1. A spark plug comprising:

a center electrode;

an insulator which accommodates the center electrode;

a metallic shell which accommodates the insulator; and a ground electrode which has a distal end portion disposed to face a forward end portion of the center electrode with a predetermined gap formed therebetween and a base end portion extending along the center electrode and joined to the metallic shell, wherein the base end portion includes a skin portion disposed on a surface side of the base end portion, an intermediate portion which is higher in thermal conductivity than the skin portion, and a core portion which is higher in hardness than the intermediate portion, and wherein a cross section containing a center axis of the spark plug and a center axis of the base end portion includes:

a first portion in which the intermediate portion is disposed inward of the skin portion and the core portion is disposed inward of the intermediate portion, a second portion which is located on a rear end side of the first portion and in which the skin portion and the core portion are in direct contact with each other, and an intersection point at which a first boundary line, a second boundary line, and a third boundary line meet with one another, the first boundary line being a boundary line between the metallic shell and the skin portion, the second boundary line being a boundary line between the metallic shell and the core portion, and the third boundary line being a boundary line between the skin portion and the core portion and extending toward a surface side from a rear-end-side end of a boundary line between the skin portion and the intermediate portion.

2. A spark plug according to claim 1, wherein in the cross section, the intersection point is present on each of opposite sides of the center axis of the base end portion.

3. A spark plug according to claim 1, wherein the first boundary line extends from the intersection point such that a distance between the first boundary line and the center axis of the base end portion increases toward the rear end side.

4. A spark plug according to claim 1, wherein the skin portion has a first outer surface which faces toward the center electrode and a second outer surface which faces toward a side opposite the first outer surface, and in the cross section, at least one of the first outer surface and the second outer surface has a straight portion which extends substantially straight from a forward end side toward the rear end side, and a curved portion which extends from the straight portion toward the rear end side while curving outward.

5. A spark plug according to claim 4, wherein in the cross section, the curved portion has a curvature radius of 0.5 mm or greater.

6. A spark plug according to claim 1, wherein in the cross section, the second boundary line is convex toward the metallic shell.

7. A spark plug according to claim 1, wherein the ground electrode is joined to an end surface of a forward end portion of the metallic shell, and when an imaginary plane which contains an end surface of a portion of the forward end portion to which the ground electrode is not joined is defined, in the cross section, a maximum value L of a distance between an imaginary straight line representing the imaginary plane and the boundary line between the ground electrode and the metallic shell satisfies a relation of $L>0$ mm, where the distance assumes a positive value when the boundary line between the ground electrode and the metallic shell is located on the rear end side of the imaginary straight line.

8. A spark plug according to claim 7, wherein the maximum value L satisfies a relation of $L\geq 0.2$ mm.

9. A spark plug according to claim 7, wherein the maximum value L satisfies a relation of $L\geq 0.4$ mm.

10. A spark plug according to claim 7, wherein the maximum value L satisfies a relation of L<1.5 mm.

11. A spark plug according to claim 1, wherein the skin portion has an aluminum content WP which satisfies a relation of 0 wt. %<WP<5.0 wt. %.

12. A spark plug according to claim 1, wherein the center axis of the base end portion defines an outer circumferential side region of the base end portion facing away from the center electrode and an inner circumferential side region of the base end portion facing toward the center electrode, and wherein the intersection point, the first boundary line, and the third boundary line are only defined in the outer circumferential side region.

* * * * *